US010004975B2

(12) United States Patent
Clement et al.

(10) Patent No.: US 10,004,975 B2
(45) Date of Patent: Jun. 26, 2018

(54) SPORTS GLOVE HAVING IMPROVED WRIST STRAP AND DORSAL SPLINT SYSTEM

(71) Applicant: HAYABUSA FIGHTWEAR INC., Kingston (CA)

(72) Inventors: Ken Clement, Milton (CA); Craig Clement, Kingston (CA); John David Zikakis, Mount Albert (CA)

(73) Assignee: HAYABUSA FIGHTWEAR INC., Kingston, Ontario (CA)

( * ) Notice: Subject to any disclaimer, the term of this patent is extended or adjusted under 35 U.S.C. 154(b) by 416 days.

(21) Appl. No.: 14/731,365

(22) Filed: Jun. 4, 2015

(65) Prior Publication Data

US 2016/0051883 A1 Feb. 25, 2016

Related U.S. Application Data

(63) Continuation-in-part of application No. 13/396,578, filed on Feb. 14, 2012, now Pat. No. 9,079,093, which (Continued)

(51) Int. Cl.

| | |
|---|---|
| ***A63B 71/14*** | (2006.01) |
| ***A41D 13/08*** | (2006.01) |
| ***A63B 69/00*** | (2006.01) |

(52) U.S. Cl.

CPC ..... *A63B 71/145* (2013.01); *A41D 13/08* (2013.01); *A63B 69/004* (2013.01); *A63B 2209/10* (2013.01); *A63B 2244/102* (2013.01)

(58) Field of Classification Search

CPC ..... A41D 13/08; A63B 2209/10; A63B 2244/102; A63B 69/004; A63B 71/145

See application file for complete search history.

(56) References Cited

U.S. PATENT DOCUMENTS 1,627,382 A 5/1927 Golomb
2,154,197 A * 4/1939 Callaway ..... A63B 71/146 2/159

(Continued)

FOREIGN PATENT DOCUMENTS

WO WO 2011/006053 A1 1/2011
WO 2013071427 A1 5/2013

OTHER PUBLICATIONS

U.S. Appl. No. 13/396,578 entitled Sports Glove Having Improved Wrist Strap and Dorsal Splint System; Filed: Feb. 14, 2012 Clement, Ken et al.

(Continued)

*Primary Examiner* — Anna Kinsaul
(74) *Attorney, Agent, or Firm* — Moore & Van Allen PLLC; Henry B. Ward, III

(57) ABSTRACT

A protective sports glove worn by athletes during training or for use in a combative event to protect against injury and increase performance (including but not limited to total force generation, grip strength, striking force and speed, muscular endurance, time to contraction, etc.). These gloves are engineered with a dorsal splint system and a cooperating adjustable dual strapping wrist tie system to secure the gloves to the contour of the hands, to ensure they remain tight and fixed, and to support the wrist from excessive bending. The dual strapping system with the dorsal splint system provides increased wrist/hand rigidity mirroring a tightness of hand wrap bandages for maximal bone and tendon support of the hands and wrists, and this novel tie system increases the transfer of force generation to the point of impact.

18 Claims, 33 Drawing Sheets

Related U.S. Application Data is a continuation-in-part of application No. 13/031,964, filed on Feb. 22, 2011, now Pat. No. 8,646,113.

(56) References Cited

U.S. PATENT DOCUMENTS

| | | | | |
|---|---|---|---|---|
| 4,287,610 | A | 9/1981 | Rhee | |
| 4,330,120 | A * | 5/1982 | Netti | A63B 21/065 2/160 |
| 4,417,359 | A | 11/1983 | Johnson | |
| D274,015 | S | 5/1984 | Golomb | |
| D281,373 | S | 11/1985 | Golomb | |
| 4,603,439 | A | 8/1986 | Golomb | |
| 4,781,178 | A | 11/1988 | Gordon | |
| 4,958,384 | A | 9/1990 | McCrane | |
| 4,984,300 | A | 1/1991 | Cho | |
| D320,872 | S | 10/1991 | McCrane | |
| 5,083,314 | A | 1/1992 | Andujar | |
| 5,146,624 | A | 9/1992 | Brückner | |
| 5,197,149 | A | 3/1993 | Overton | |
| 5,295,269 | A | 3/1994 | Ballard | |
| D362,927 | S | 10/1995 | McCrane | |
| 5,459,883 | A | 10/1995 | Garceau-Verbeck | |
| 5,513,391 | A | 5/1996 | Garneau et al. | |
| 5,537,692 | A * | 7/1996 | Dorr | A41D 19/01588 2/16 |
| 5,575,008 | A | 11/1996 | McBride et al. | |
| 5,706,521 | A | 1/1998 | Haney | |
| 5,758,365 | A | 6/1998 | Steeley | |
| 5,802,614 | A | 9/1998 | Melone, Jr. | |
| 6,119,267 | A | 9/2000 | Pozzi | |
| 6,178,553 | B1 | 1/2001 | Bolton | |
| 6,543,057 | B2 | 4/2003 | Beland et al. | |
| 6,553,576 | B1 | 4/2003 | Knapp | |
| 6,604,244 | B1 | 8/2003 | Leach | |
| 6,889,389 | B2 | 5/2005 | Kleinert | |
| 7,537,577 | B2 | 5/2009 | Phelan et al. | |
| 7,694,351 | B2 | 4/2010 | Gait | |
| 8,060,949 | B2 | 11/2011 | Carcaterra et al. | |
| 8,303,527 | B2 * | 11/2012 | Joseph | A61F 5/01 128/869 |
| 8,474,063 | B2 | 7/2013 | Coulter et al. | |
| 2005/0193466 | A1 | 9/2005 | Avallone | |
| 2009/0320178 | A1 | 12/2009 | Faulconer | |
| 2011/0067165 | A1 | 3/2011 | Fream et al. | |
| 2011/0277205 | A1 | 11/2011 | Cuadrado | |
| 2012/0131715 | A1 | 5/2012 | Copeland et al. | |
| 2012/0204304 | A1 | 8/2012 | Pechtold | |
| 2013/0000006 | A1 | 1/2013 | Norton et al. | |
| 2013/0014306 | A1 | 1/2013 | Mechling et al. | |
| 2013/0227755 | A1 | 9/2013 | Bisaillon | |
| 2014/0257159 | A1 | 9/2014 | Kelly | |

OTHER PUBLICATIONS

U.S. Appl. No. 13/031,964 entitled Sports Glove Having Improved Wrist Strap; Filed: Feb. 22, 2011 Clement, Ken et al.

Canadian Intellectual Property Office. PCT International Search Report and Written Opinion dated Oct. 13, 2011. International Application No. PCT/CA2011/050107. Name of Applicant: Hayabusa Fightwear Inc. English Language.

* cited by examiner

SPORTS GLOVE HAVING IMPROVED WRIST STRAP AND DORSAL SPLINT SYSTEM

RELATED APPLICATIONS

This application is a Continuation-In-Part of U.S. patent application Ser. No. 13/396,578 filed 14 Feb. 2012, entitled SPORTS GLOVE HAVING IMPROVED WRIST STRAP AND DORSAL SPLINT SYSTEM, which is a continuation-in-part of U.S. patent application Ser. No. 13/031,964 filed on Feb. 22, 2011, entitled SPORTS GLOVE HAVING IMPROVED WRIST STRAP, the entire contents of which is hereby incorporated by reference, and from which priority is claimed under 37 U.S.C. § 120.

FIELD OF THE INVENTION

This invention relates to a combat sports glove designed for improved fit and function. More specifically, the invention relates to a combat sports glove having an adjustable dual system wrist support system and/or a dorsal splint system.

BACKGROUND OF THE INVENTION

Combat athletes, especially mixed martial arts (MMA) practitioners, use gloves on the hand that, generally, are cumbersome, thick, non form-fitting and lack in adequate wrist and hand support. As well, these gloves, with repetitive use, quickly lose the ability to maintain proper fit and function. This can lead to a decrease in force generation and related hand and fist functioning and can also lead to injury. Another shortcoming of these conventional combat gloves is that, when the glove strikes a target or opponent, the hand can be loose and the wrist can be unstable. It can therefore be appreciated that force loss and injury can be experienced by the athlete during training and during a competitive event. Maintaining maximal force transmission in relation to striking force and grip strength are key factors to support performance during stand up or ground combat. Injury prevention is also of great importance to these athletes, especially in relation to protection for the hands and fists. In particular, through repeated use and wear, the glove fit may become loose to such an extent that the glove fit is inadequate for the glove to function properly.

SUMMARY OF THE INVENTION

The present invention provides systems and devices relating to a protective sports glove. The glove may be used during training or in combat events that may require striking an opponent with the hand or with parts of the hand. The glove is used to protect against injury and as well as to increase performance. The present invention provides for a glove that uses a dorsal splint system, which may be used in combination with an adjustable dual strap wrist securement system to secure the glove to the contour of the hand and of the wrist. The splint system provides support for the wrist by preventing the wrist from excessive bending when the glove is securely worn.

The further combination of the dorsal splint system with a dual strap wrist securement system ensures that the glove remains tightly fitted and fixed. The use of the dual strap system with the dorsal splint system also provides increased wrist and hand rigidity that mirrors the tightness of hand wrapped bandages for maximal bone and tendon support of the hands and wrists. This system also advantageously increases the transfer of force to the point of impact.

In a first aspect, the present invention provides a protective glove comprising:

- a body having:
  - a dorsal side;
  - a volar side;
  - a finger portion for fingers, the finger portion having a finger dorsal side and
  - a finger volar side;
  - a wrist portion for a wrist, the wrist portion having a wrist dorsal side and a
  - wrist volar side;
  - a splint portion for supporting said wrist, said splint portion being adjacent to said wrist portion;
  - a gap closure system for securing said wrist portion to said wrist;
- wherein the finger portion has a first section for enclosing at least one finger and a second section for encircling a thumb; and
- wherein wrist volar side of said wrist portion has a gap for adjustably securing the glove to accommodate the wrist, said gap closure system also being for closing said gap.

In another aspect, the present invention provides a protective glove for use by a user, the glove comprising:

- a dorsal side;
- a volar side;
- a finger portion for fingers, the finger portion being for enclosing at least one finger of said user;
- a wrist portion for a wrist of said user, the wrist portion having a wrist dorsal side and a wrist volar side;
- a splint portion for supporting said wrist, said splint portion being adjacent said wrist portion, said splint portion being resistant to a bending of said wrist;
- a gap closure system for securing said wrist portion to said wrist;
- wherein wrist volar side of said wrist portion has a gap for adjustably securing the glove to accommodate the wrist, said gap closure system also being for closing said gap.

Yet a further aspect of the invention provides glove comprising:

- a finger portion for fingers, the finger portion being for enclosing at least one finger;
- a wrist portion for a wrist, the wrist portion having a wrist dorsal side and a wrist volar side;
- a splint portion for supporting said wrist, said splint portion being adjacent said wrist portion, said splint portion being resistant to a bending of said wrist, said splint portion being positioned on a dorsal side of said glove;
- a gap closure system for tightly securing said wrist portion to said wrist;
- wherein said wrist volar side of said wrist portion has a gap for adjustably securing the glove to accommodate the wrist, said gap closure system also being for closing said gap.

BRIEF DESCRIPTION OF THE DRAWINGS

Embodiments of the invention have been chosen for purposes of illustration and description and are not intended to be limiting. Throughout the drawings, like elements are referred to by like numerals.

DETAILED DESCRIPTION

While the various embodiments of the present invention are herein described with specific examples, those examples are not intended to be limiting, and those of skill in the art will appreciate and recognize other embodiments and advantages of the present invention.

Referring now to the figures, in which like parts are identified by like numerals throughout all figures, a glove according to a preferred embodiment of the invention will be described in detail.

It should be noted that commonly accepted anatomical names are used throughout this document to refer to parts of the hand and corresponding parts of the gloves according to various embodiments of the present invention. The term dorsal refers to the back or top of the hand. The term volar refers to the bottom or palm-side of the hand. The thumb is understood to be considered the first finger but is most commonly herein referred to as the thumb. The remaining fingers, proceeding from the first or index finger, are herein referred to as the second, third, fourth, and fifth fingers.

Figure 1A:
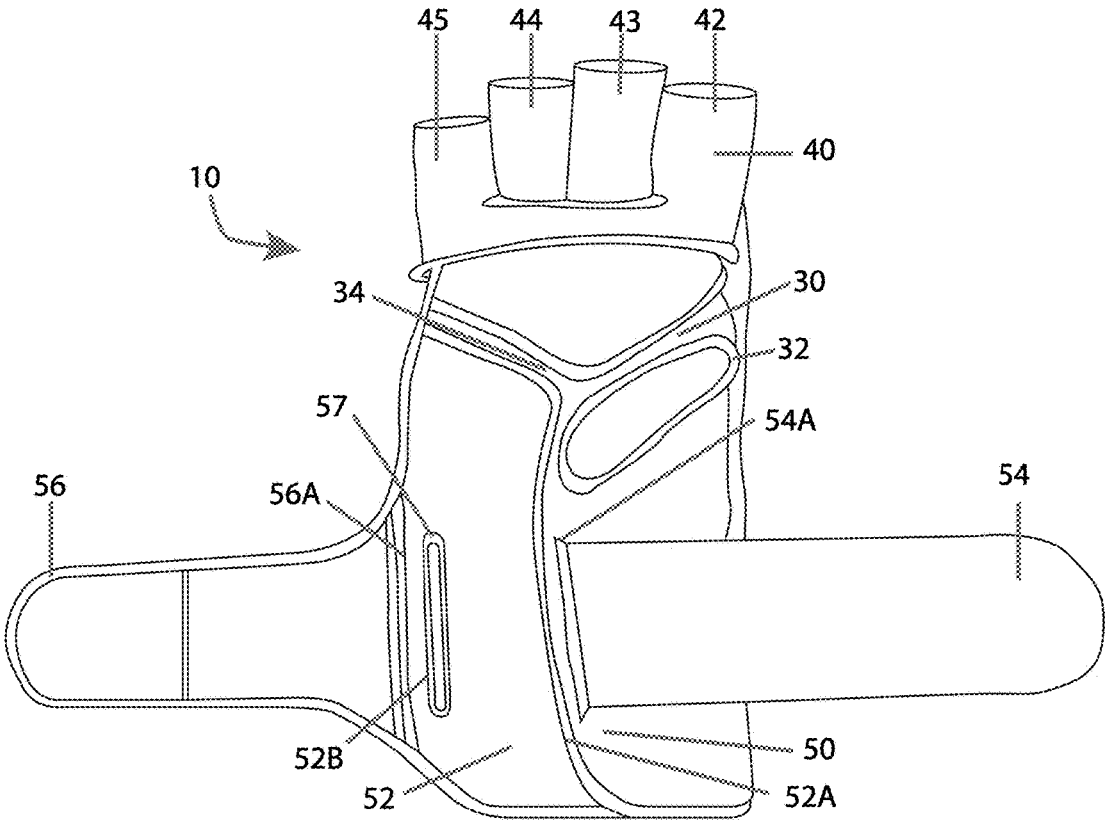
FIG. 1A is a palm view of a glove having both straps in an unsecured or unfastened open position according to one embodiment of the invention.
Figure 1B:
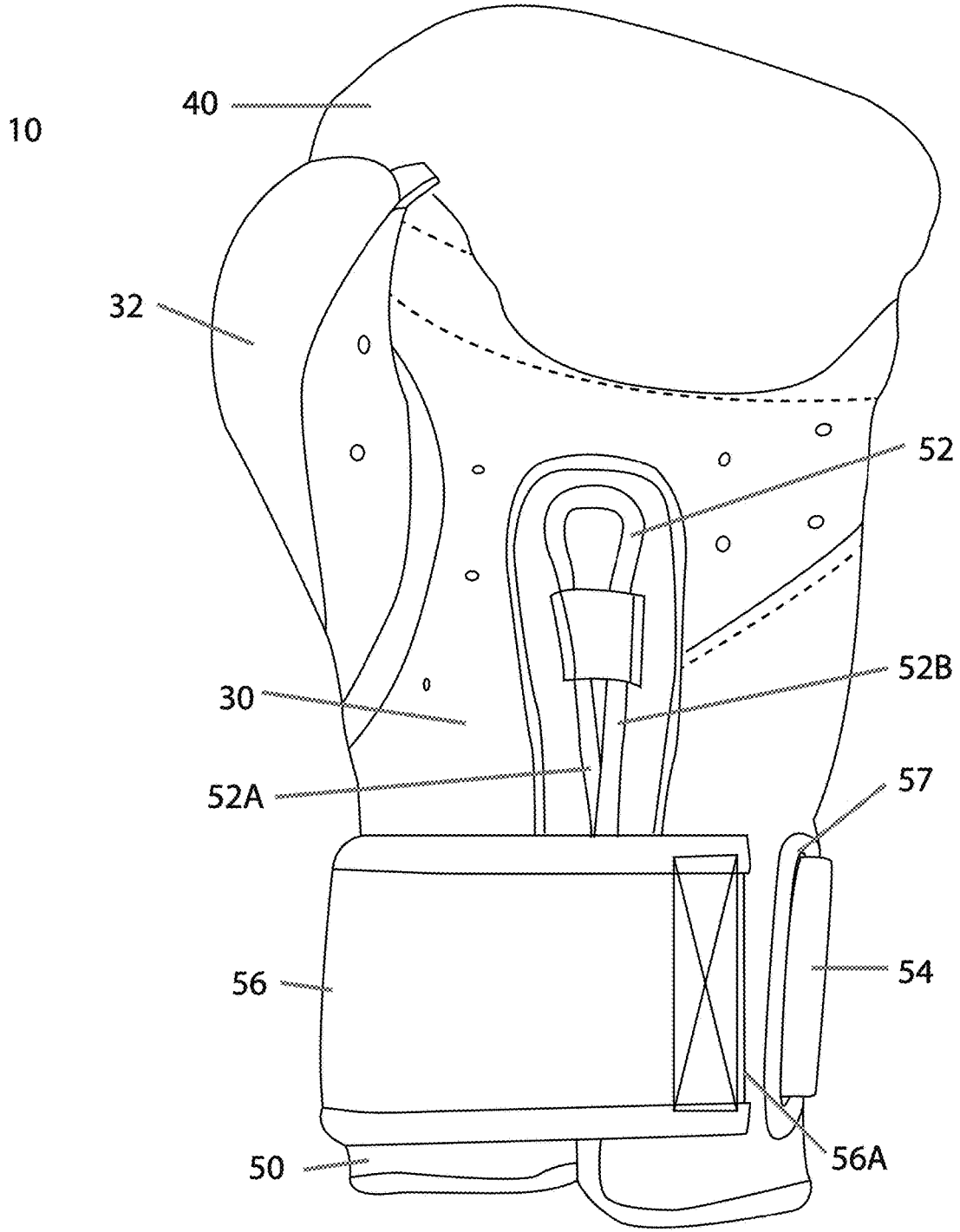
FIG. 1B is a palm view of a glove having both straps secured in a closed configuration according to one embodiment of the present invention.

Referring to FIG. 1A, a protective glove for use in combat sports such as mixed martial arts is illustrated. In FIG. 1B, a boxing glove that may be used in similar activities is illustrated. The following description applies to both FIGS. 1A and 1B with similar features being referred to by the same reference numerals. It should be noted that FIGS. 1A-4A illustrate a right handed glove while FIGS. 1B-4B illustrate a left-handed glove. Referring to FIGS. 1A and 1B, a glove 10 is shown in palm view, i.e. viewed from the side of the palm and not the dorsal side. Glove 10 has a dorsal portion (not visible in this view) having a splint portion 22, a volar portion 30, a thumb portion 32, a finger portion 40, and a wrist portion 50. Wrist portion 50, in the embodiment shown, is formed with a gap 52, having a thumb-side edge 52A and an opposing-side edge 52B. A primary support strap 54 is attached to the thumb-side edge 52A (not visible in FIG. 1B) and a secondary support strap 56 is attached to the opposing-side edge 52B at 56A. The opposing-side edge 52B has a slot 57 through which primary support strap 54 passes through.

Figure 2A:
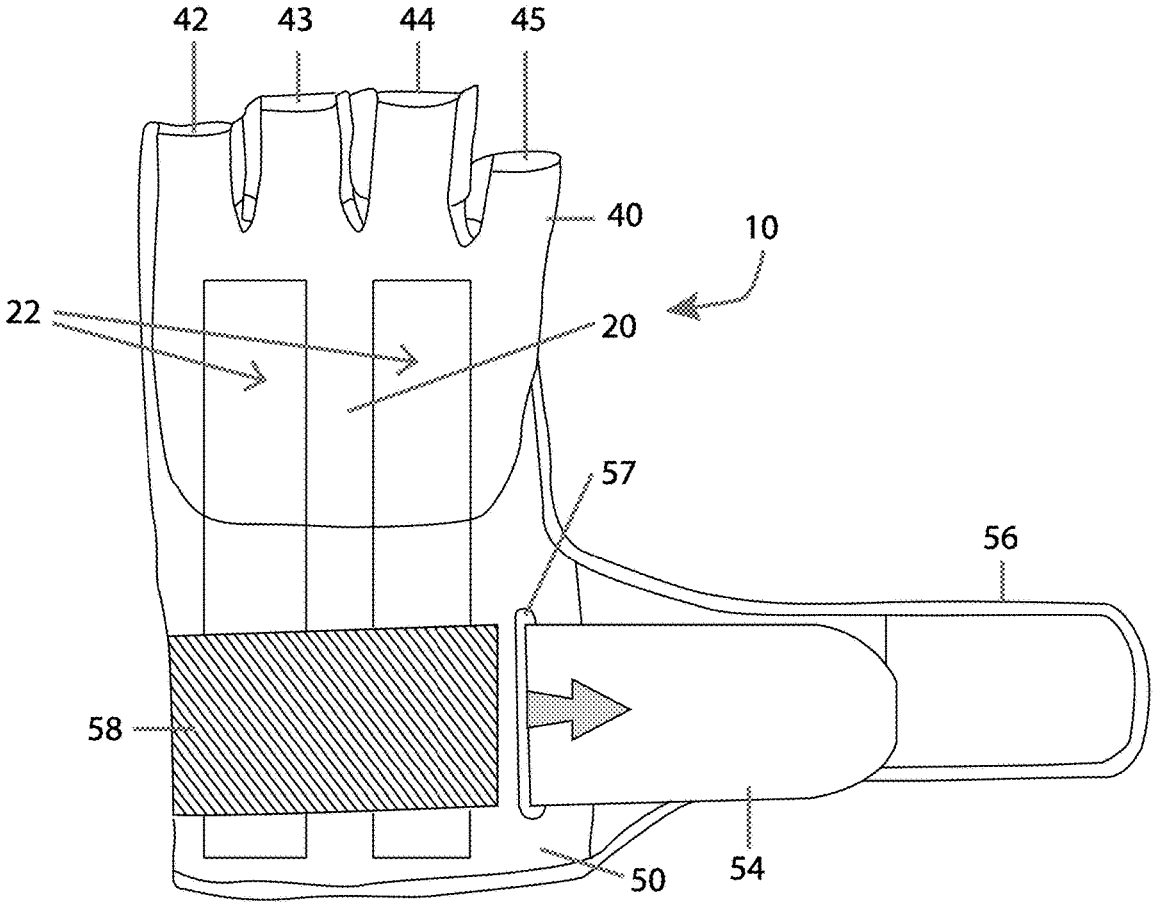
FIG. 2A is a dorsal view of the glove in FIG. 1A showing the straps in an unsecured or opened position.
Figure 2B:
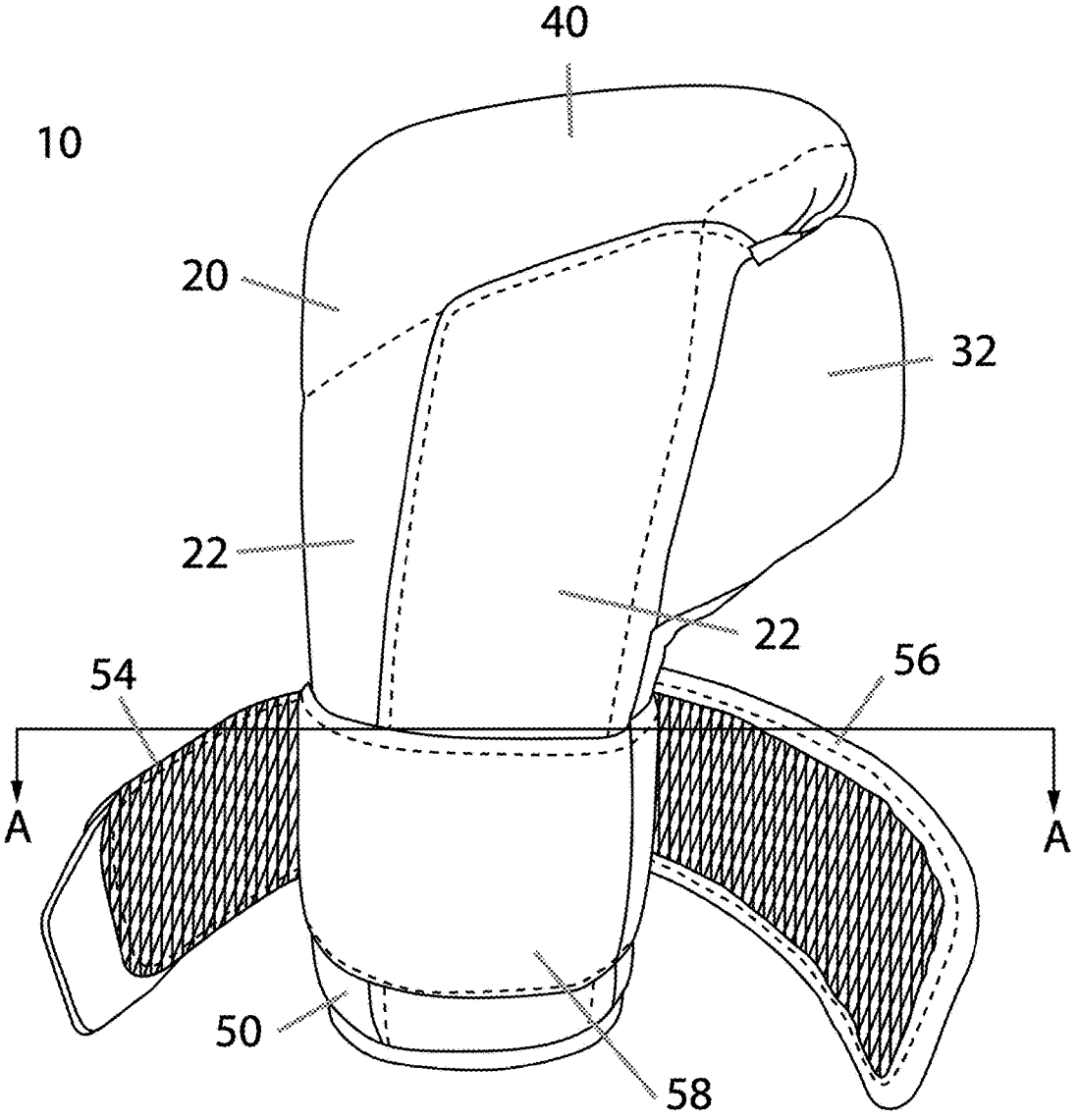
FIG. 2B is a dorsal view of the glove shown in FIG. 1B having both straps in an unsecured or unfastened opened position according to another embodiment of the present invention.

In use, an individual places their hand inside glove 10. When the primary support strap 54 and the secondary support strap 56 are unsecured, the gap 52 allows for the wrist portion 50 and the volar portion 30 to open and accommodate the hand, the hand being larger in circumference in some regions than the wrist. The individual's thumb passes into the thumb portion 32 and their second, third, fourth, and fifth fingers pass into finger portion 40. Primary support strap 54 is passed through the slot 57. FIG. 2A shows the opposite side (dorsal) of the glove 10 shown in FIG. 1A while FIG. 2B shows the dorsal side of the glove in FIG. 1B. In FIGS. 2A and 2B, the primary support strap 54 is passed through the slot 57 (not shown in FIG. 2B). FIGS. 2A and 2B also show that the dorsal portion 20 has both straps in the open position. As shown in the drawings, the dorsal portion 20 contains two individual support elements that make up the splint portion 22. The support elements together form the splint portion 22 that extends from the finger portion 40 down to the wrist portion 50 such that the support straps overlay a portion of the splint portion 22.

Once the primary strap 54 has been passed though the slot 57, the wrist portion 50 can now be tightly secured to the wrist, thereby ensuring a secure fit for the glove. In FIGS. 3A-4A and 3B-4B, this process is illustrated for the two types of gloves shown. Primary strap 54 is pulled tightly in the direction of the block arrow shown in FIGS. 3A and 3B as the primary strap 54 wraps around the wrist portion of the glove. In one aspect of the preferred embodiment, the primary support strap 54 has an elastic portion, preferably near the thumb-side attachment 54A (not shown in FIGS. 3A, 3B). As the primary support strap 54 is pulled, it narrows or closes the gap 52 tightly to thereby conform the glove to the wearer's hand and wrist, thereby producing a tight, supportive fit. The dorsal side of wrist portion 50 may include a region 58 having means to accommodate reversible fastening of the gap closure system, in particular the primary support strap 54, which in turn also contains a means to facilitate reversible fastening (of the secondary support strap 56). In one implementation, the means to facilitate reversible fastening are preferably of the hook-and-loop type of fastening, such as that marketed under the name Velcro®. Other methods or means for reversible fastening are, of course, possible. Snaps, buttons, hooks, and other closure and/or attachment means and methods may be used.

Figure 4A:
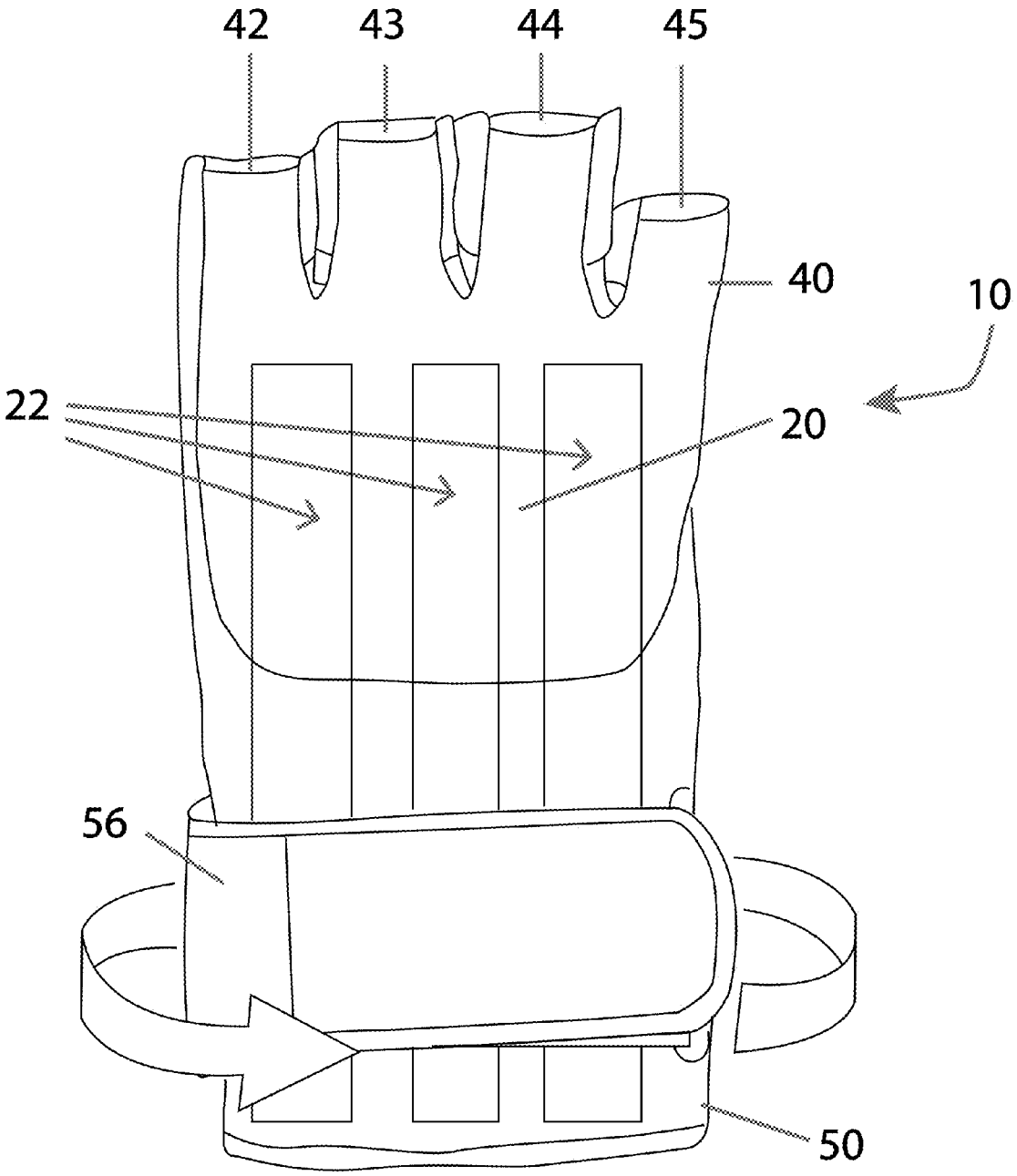
Figure 4B:
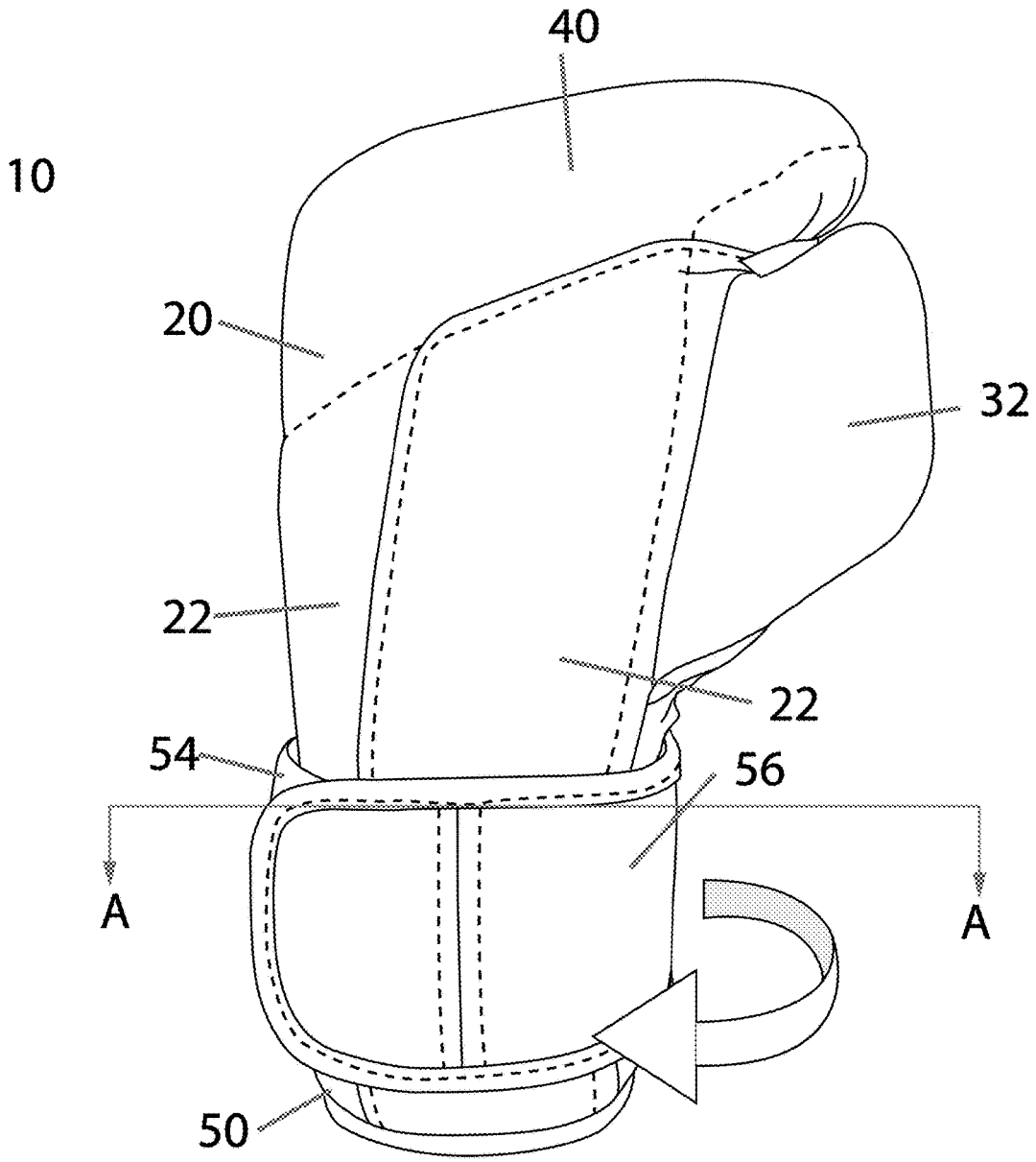

Next, now referring to FIGS. 4A and 4B, the secondary support strap 56 is pulled tightly in the direction of the block arrow shown back in the opposite direction relative to the direction by which the primary strap wraps around the wrist portion, across over the dorsal side of wrist portion 50 and securely fastens over the primary support strap 54 at region 58 (not shown in FIG. 4).

Figure 3A:
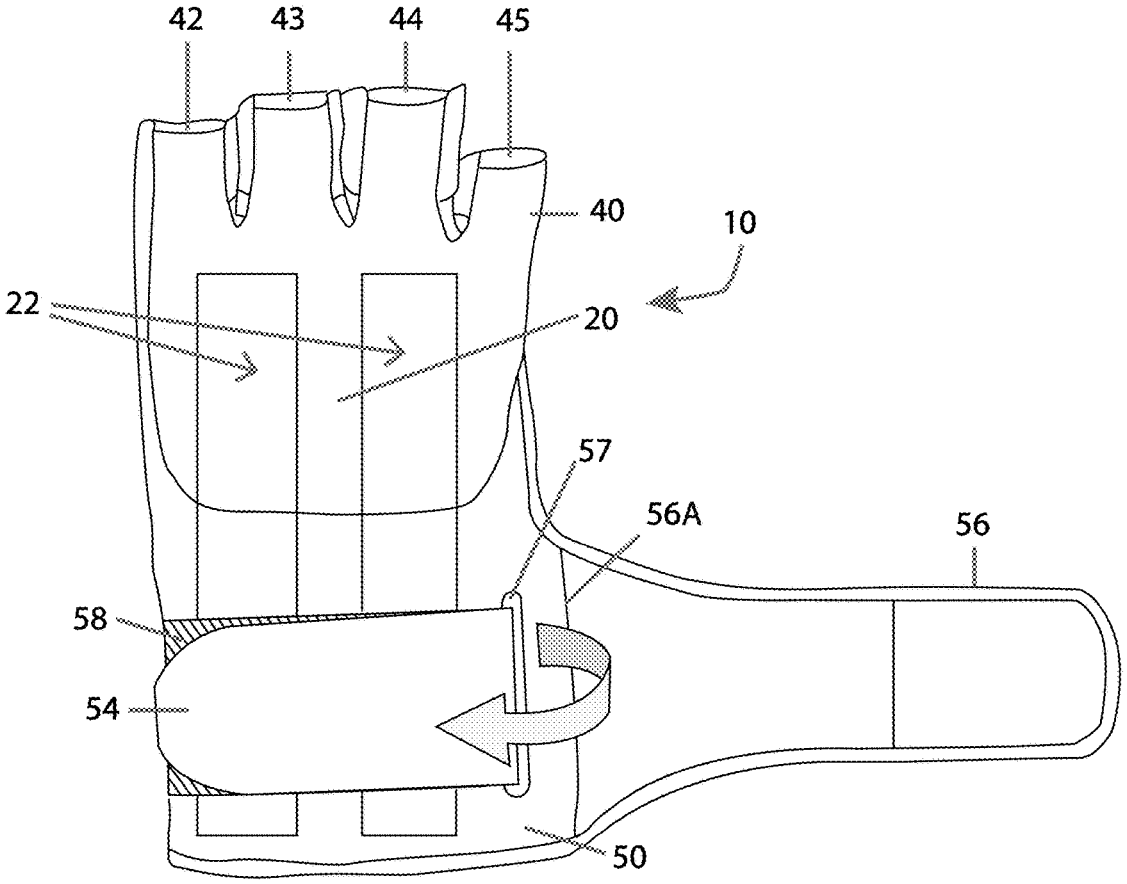
FIGS. 3A and 4A illustrate dorsal views of the glove in FIG. 1A showing the steps for securing the straps to the user's wrist to secure the glove.
Figure 3B:
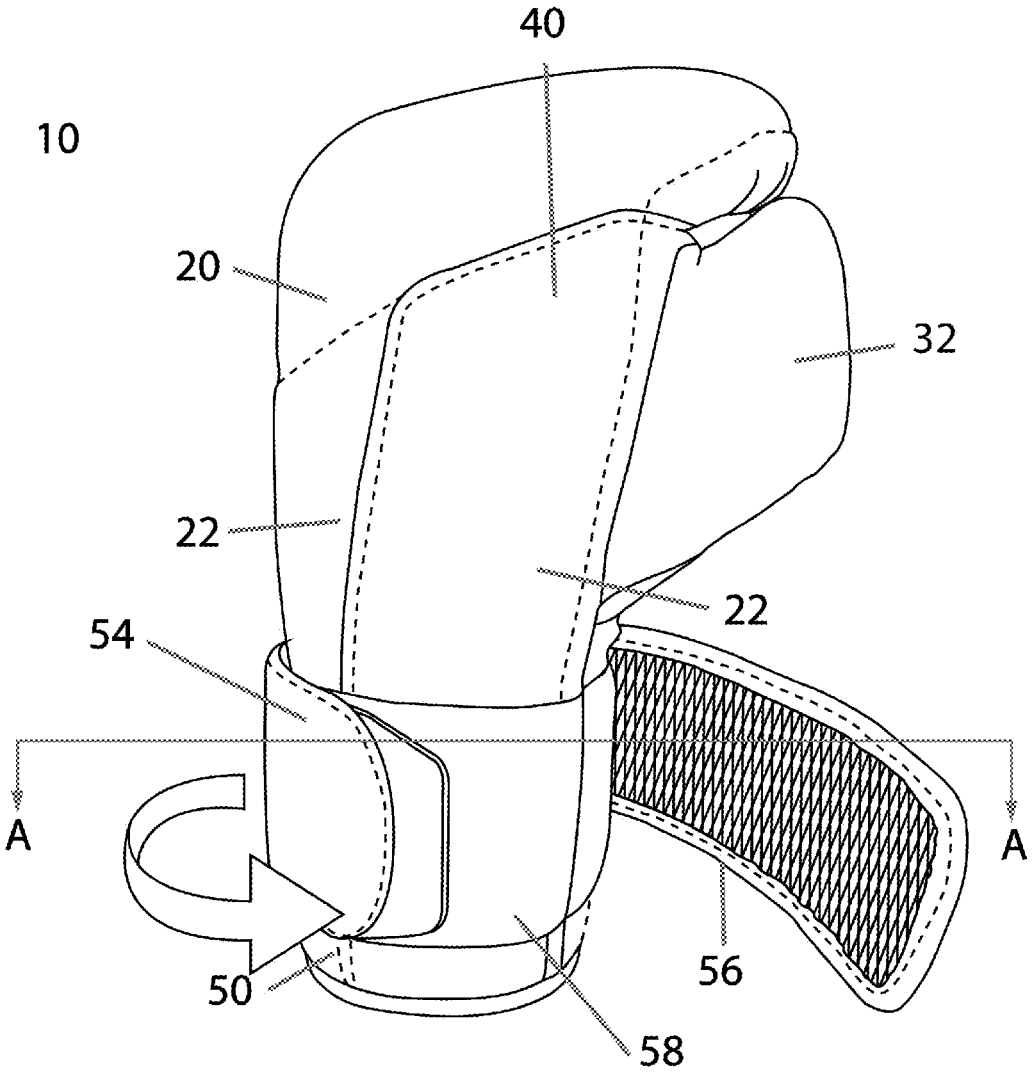
FIGS. 3B and 4B illustrate dorsal views of the glove in FIG. 1B showing the steps for securing the straps to the user's wrist to secure the glove.

Regarding FIG. 4A, it should be noted that in FIGS. 1A, 2A, and 3A, the splint portion 22 has two individual support elements. However, in FIG. 4A, the splint portion 22 has an array of individual support elements. This illustrates that the splint portion 22 may have multiple support elements or may have a single support element.

Figure 5:
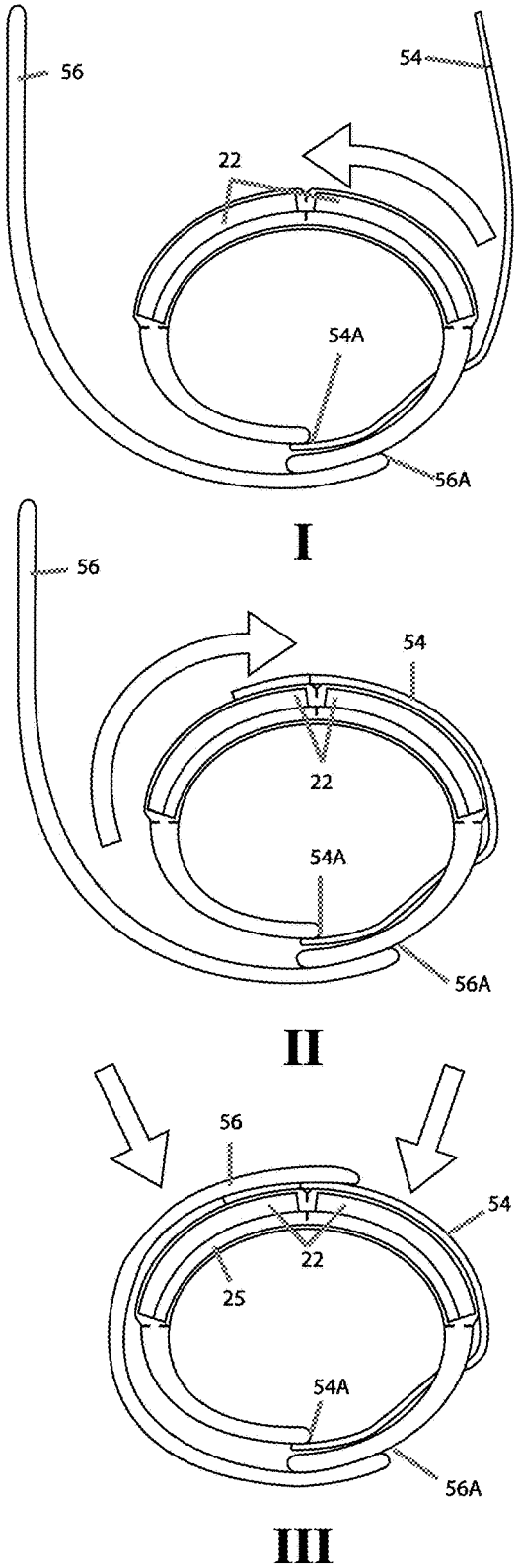
FIG. 5 is a cross-section sequence view along line A-A of FIGS. 2B through 4B showing the sequence of securing the primary and secondary straps according to another embodiment of the present invention.

For a better understanding of the relationship between the primary and secondary support straps 54 and 56, FIG. 5 is provided. Referring now to FIG. 5, a sequence of cross-sections (I, II, and III) of the glove 10 are taken from configurations shown in FIGS. 2B, 3B, and 4B along line A-A through the wrist portion 50 showing the region where the primary support strap 54 and secondary support strap 56 overlap a portion of the two individual support elements forming the splint portion 22. The block arrows of FIGS. 5I, II, and III correspond to the block arrows of FIGS. 2B, 3B, and 4B, respectively, and show the direction of strap movement. To facilitate reversible fastening, secondary support strap 56 has means to facilitate fastening. To secure secondary support strap 56, it is, from the unsecured position (shown in FIGS. 2B, 5I, and 5II), first pulled tightly in the direction of the block arrow shown across the volar side of wrist portion 50, then around to the dorsal side of wrist portion 50 and then across the dorsal side of wrist portion 50 and fastened overtop the secured primary support strap 54—the primary support strap 54 already being secured to region 58. In one aspect, the primary support strap 54 has reversible fastening means on both sides to facilitate fastening to region 58 and to facilitate fastening of the secondary support strap 56. In another aspect, the secondary support strap 56 contains at least a portion of a non-stretch material. Preferably, the non-stretch material is nylon. Most preferably, the non-stretch nylon is 420D nylon. Thus, the glove 10, in a secured and/or closed configuration as shown in FIGS. 1B, 4B, and 5III, provides wrist support through the interaction of the dorsal splint system, and the individual support elements of the splint portion 22, thereof, interacting with the primary 54 and the secondary 56 support straps, which, when secured at wrist portion 50, function as a single reinforcing structure 25 shown in FIG. 5III. It should be noted that for the embodiment in FIGS. 1A, 2A, 3A, 4A, the same system is applicable as the secondary support straps are secured overtop the primary support straps once the primary support straps have been secured to the wrist portion atop the overlaid splint portion. As with the glove in FIGS. 1B 2B, 3B, 4B, the glove in FIGS. 1A, 2A, 3A, 4A, provides a suitable support system for both the hand and the wrist once the straps have been properly secured to the wrist portion.

Gloves in accordance with the present invention provide improved wrist closure and support for improved fit and function by providing a dual cross directional strap system for use in conjunction with a volar and/or dorsal splint system to provide protection for the front and/or back of the hand and the wrist. It has been found that gloves not made in accordance with the various embodiments of the invention would become loose due to stretching of the wrist closure within about two months of regular use. Advantageously, gloves in accordance with the various embodiments of the present invention seek to avoid this rapid loosening and maintain proper fit and function for longer time.

Figure 6A:
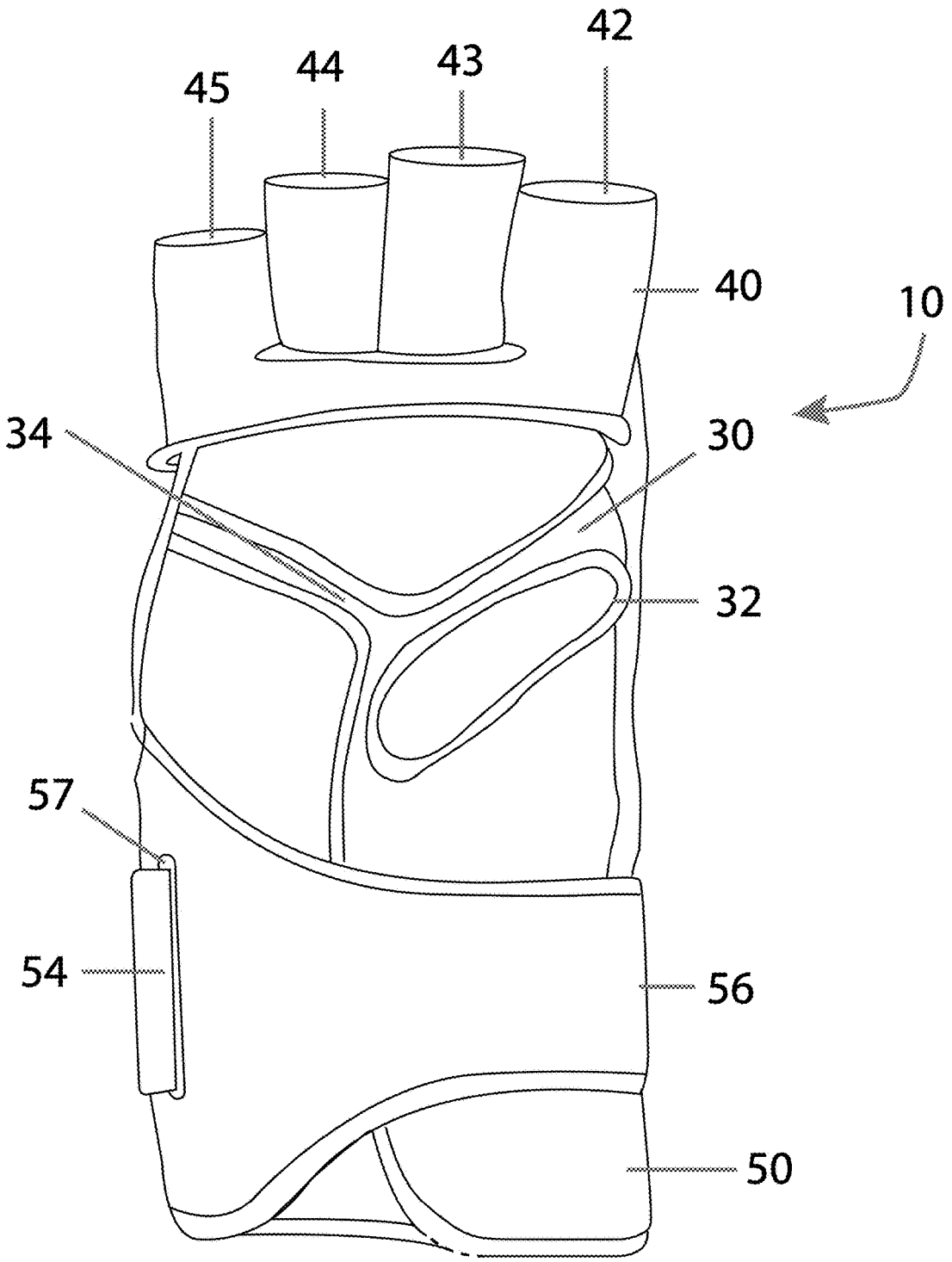
FIG. 6A is a palm view of an alternative embodiment of the glove illustrated in FIG. 1A.
Figure 6B:
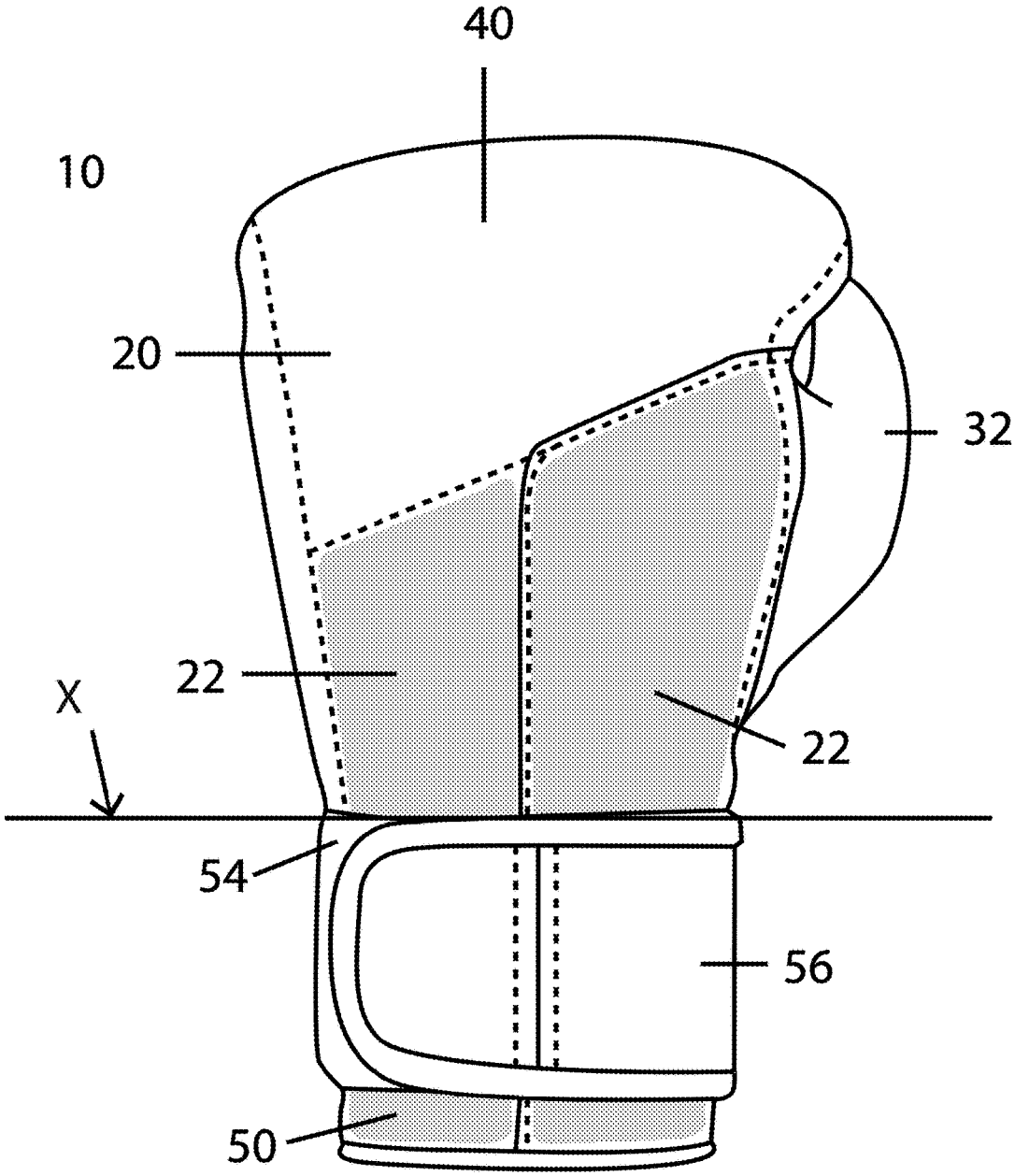
FIG. 6B is a dorsal view of an embodiment of the glove illustrated in FIG. 1B showing multiple support elements for the splint portion.
Figure 6C:
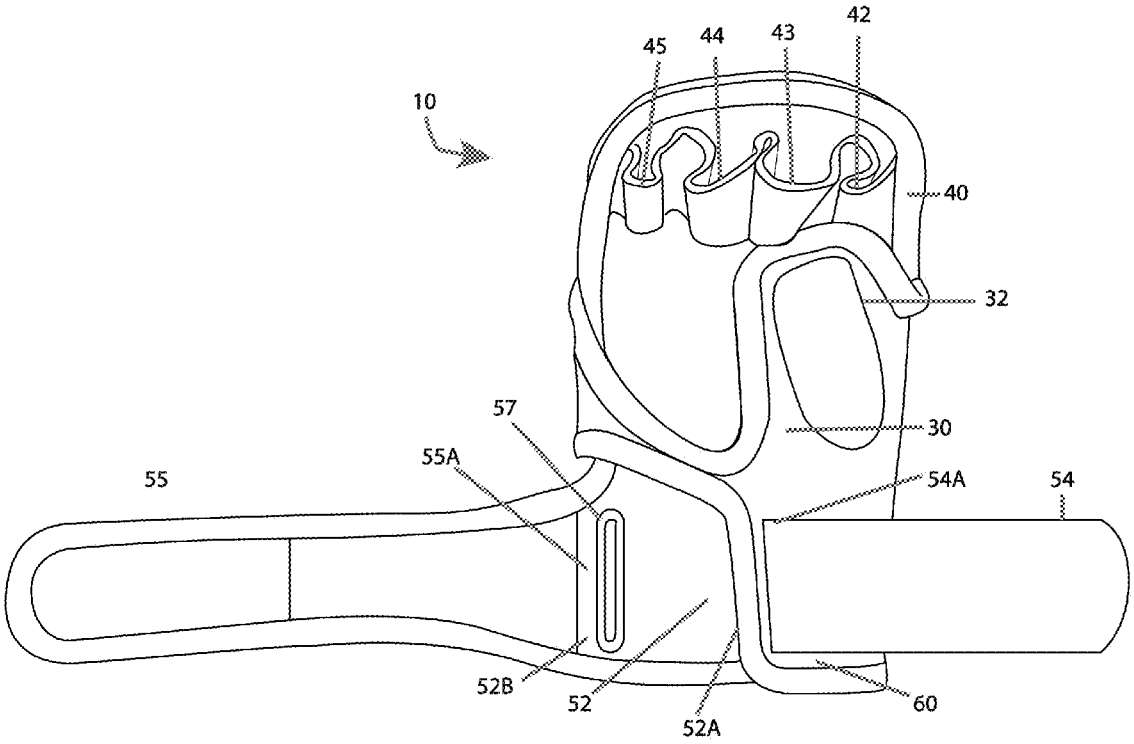
FIG. 6C is a palm view of an alternative embodiment of the glove illustrated in FIG. 1A.

Referring to FIG. 6A, a palm view of the glove in FIGS. 1A, 2A, 3A, and 4A is illustrated with the dual support straps deployed. FIG. 6B illustrates a dorsal view of the glove in FIGS. 1B, 2B, 3B, and 4B with the dual support straps deployed. The splint portion 22 with two support elements being overlaid by the two support straps can clearly be seen in the dorsal side of the glove. As can be seen, the splint portion 22 runs longitudinally from approximately where the finger portion 40 begins to the edge of the wrist portion 50. The splint portion is longitudinally perpendicular to the axis of bending X of the wrist parallel to the longitudinal axis of a user's forearm. Referring to FIG. 6C, a palm view of another embodiment of a glove for use in martial arts is illustrated. As can be seen, this embodiment in FIG. 6C corresponds to the view in FIG. 1A, the main difference being the configuration of the finger portion 40 and the thumb portion 32. In FIG. 1A, the finger portion has individual sleeves into which each finger is inserted while in FIG. 6C, the finger portion 40 is comprised of loops 42, 43, 44, 45 for individually accepting the second, third, fourth, and fifth proximal phalanges. As well, in FIG. 1A, the thumb portion 32 is an opening which encircles the base of the user's thumb.

In the configuration of FIG. 6C, the thumb portion has a sleeve which encloses at least a portion of the user's thumb. It should be clear that, in some embodiments, the dorsal side 20 contains padding material to protect the dorsal part of the hand and the proximal phalanges portions of the second, third, fourth, and fifth fingers.

Again referring to both FIGS. 6A and 6B, the splint portion 22, according to one aspect of the present invention, is comprised of multiple sections of support material incorporated into the dorsal side of the glove. The dual straps of the gap closure system secures over part of the splint portion, this part being overlaid by the dual straps being the part distal to the fingers. The splint portion comprises multiple separate elements, preferably two. The gloves according to this embodiment limit movement of the wrist and are therefore intended to be used primarily for striking activities. When the glove is not being worn and the dual straps of the gap closure system are loose, the multiple elements of the splint portion are free to move and bend relative to one another, and the multiple elements allow the user's hands to be inserted into the gloves and allow wrist movement. Once the gap closure system has been secured, the straps encircle at least part of the wrist portion and at least part of the splint portion. Once secured, the gap closure system allows the elements of the splint portion to engage and support one another, thereby providing support for the wrist as well as protection for the back of the hand. It should be noted that the use of multiple support elements in the splint portion allows for greater support and protection than what would result from the use of a single support element.

It should also be noted that the splint portion provides support for the wrist by being resistant to wrist bending. When a user strikes an opponent or an object, a more solid strike is achieved if the wrist is less liable to bend. While completely preventing wrist bending is not preferable as this may constrain the user's options when it comes to fighting moves (e.g., some grappling holds and heel of palm strikes are difficult if not impossible if the wrist is completely prevented from bending), wrist support by wearing a glove that is resistant to wrist bending helps deliver a more powerful blow as more of the force is directed at the target and less force is diverted by the bending of the wrist. In addition to this, the tight fit between the glove and the user's hand (and especially to the user's wrist) provided by the gap closure system provides advantages as well. By providing a tight compressive fit to the user's wrist, the gap closure system gives advantages similar to that provided by the user taping his or her wrist. Wrist support due to the splint portion and the gap closure system allows for improvements in total force transference, striking force and speed, muscular endurance, grip strength and time to contraction.

Figure 7:
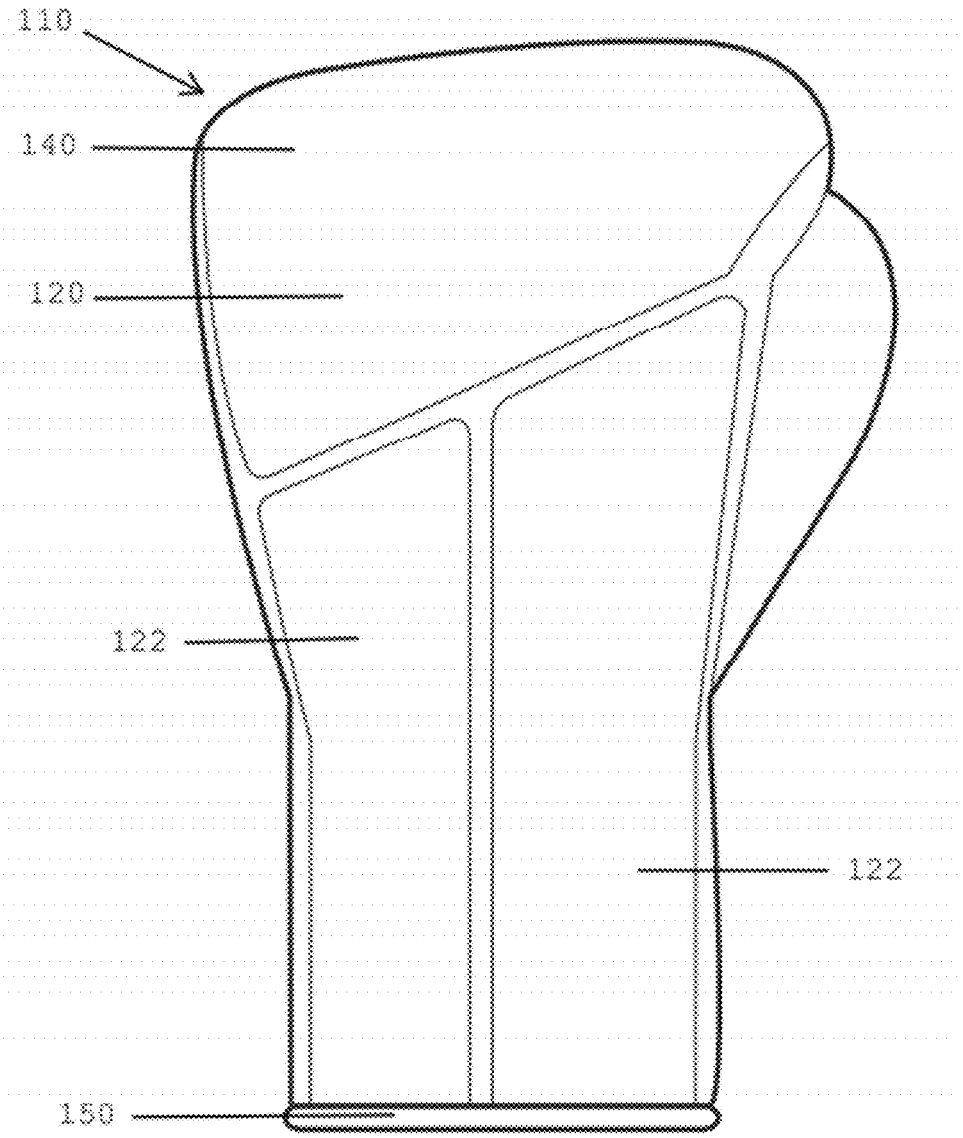
FIGS. 7 and 8 are dorsal and palm views of an alternative embodiment of the glove in FIG. 1B featuring a lace-based gap closure system and using multiple support elements for the splint portion.
Figure 8:
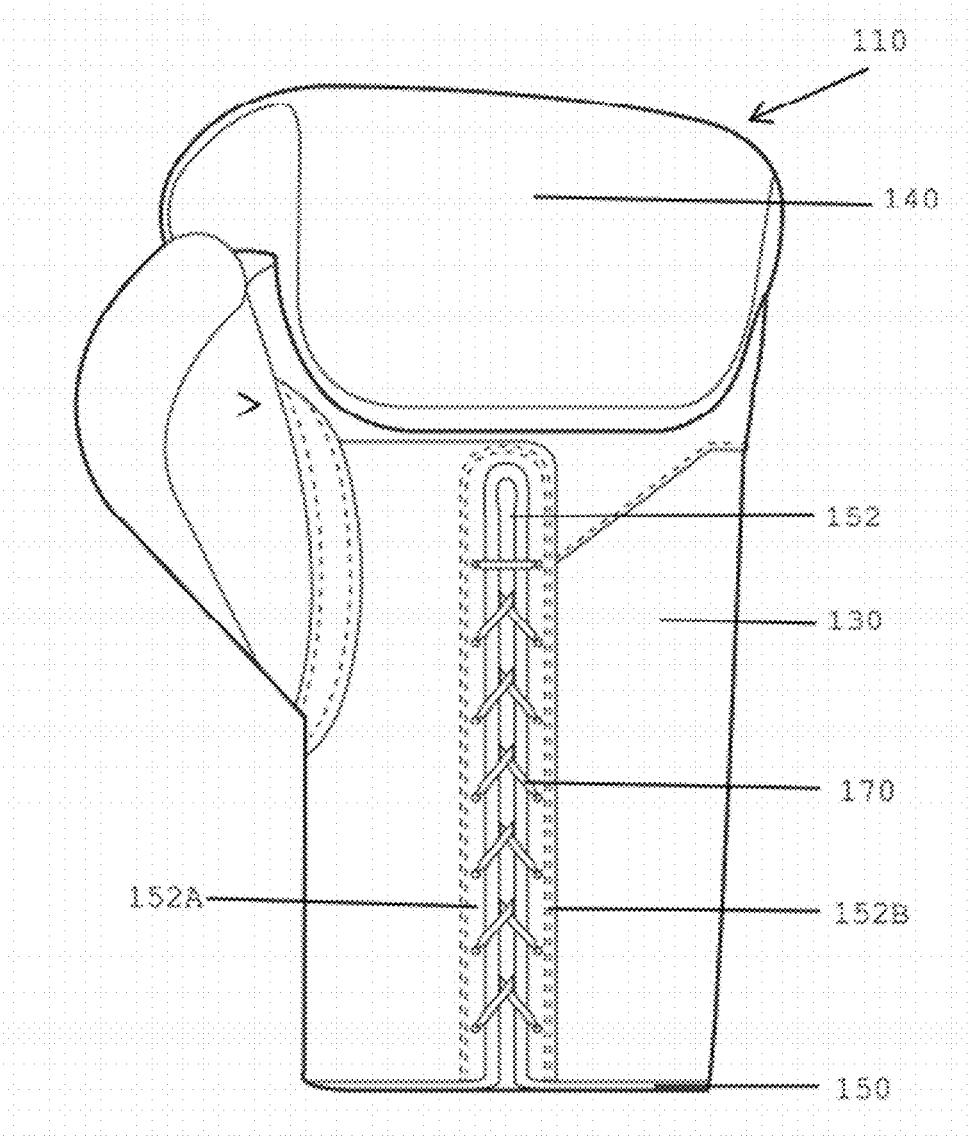

Referring to FIGS. 7 and 8, illustrated is an alternative embodiment of the present invention. FIG. 7 is a dorsal view of this alternative embodiment while FIG. 8 is a palm side view of the glove. As can be seen, the glove 110 has a dorsal portion 120, a volar portion 130, a finger portion 140, a wrist portion 150, and a splint portion 122. Finger portion 140 has two separate compartments: one for receiving the thumb and one for receiving the second, third, fourth, and fifth fingers. FIG. 7 shows the glove 110 in dorsal view showing the splint portion 122 with two splint support elements. FIG. 8 shows glove 110 in from a palm side view showing the wrist portion 150 and a gap 152. The wrist portion 150 has a thumb-side edge 152A and an opposing-side edge 152B, both edges being adjacent to the gap 152. The gap 152 allows for the wrist portion 150 and volar portion 130 to open and accommodate the hand. A gap closure system facilitates the closure of the gap 152. In this embodiment, the gap closure system takes the form of at least one lace threaded through a number of corresponding eyes, one set of eyes being located on the thumb-side edge 152A and another set of eyes being located on the opposing-side edge 152B. The lace 170 is threaded through the eyes and across the gap 152. The gap 152 is closed (and the glove tightened on the wrist) by pulling the lace 170 and this pulls the thumb-side edge 152A and the opposing-side edge 152B closer to one another. By further pulling the lace 170 until the two edges are as close to each other as possible, this forms a tight fit of the wrist portion 150 to the wrist.

As with some embodiments described above, the splint support elements on the splint portion 122 attached to the dorsal portion 120 of glove 110 extends from the wrist portion 150 to approximately the starting point of the finger portion 140. In another alternative, the splint portion is located on the volar side 130 of glove 110 and longitudinally extends from the wrist portion 150 to a point prior to the finger portion 140.

Figure 9:
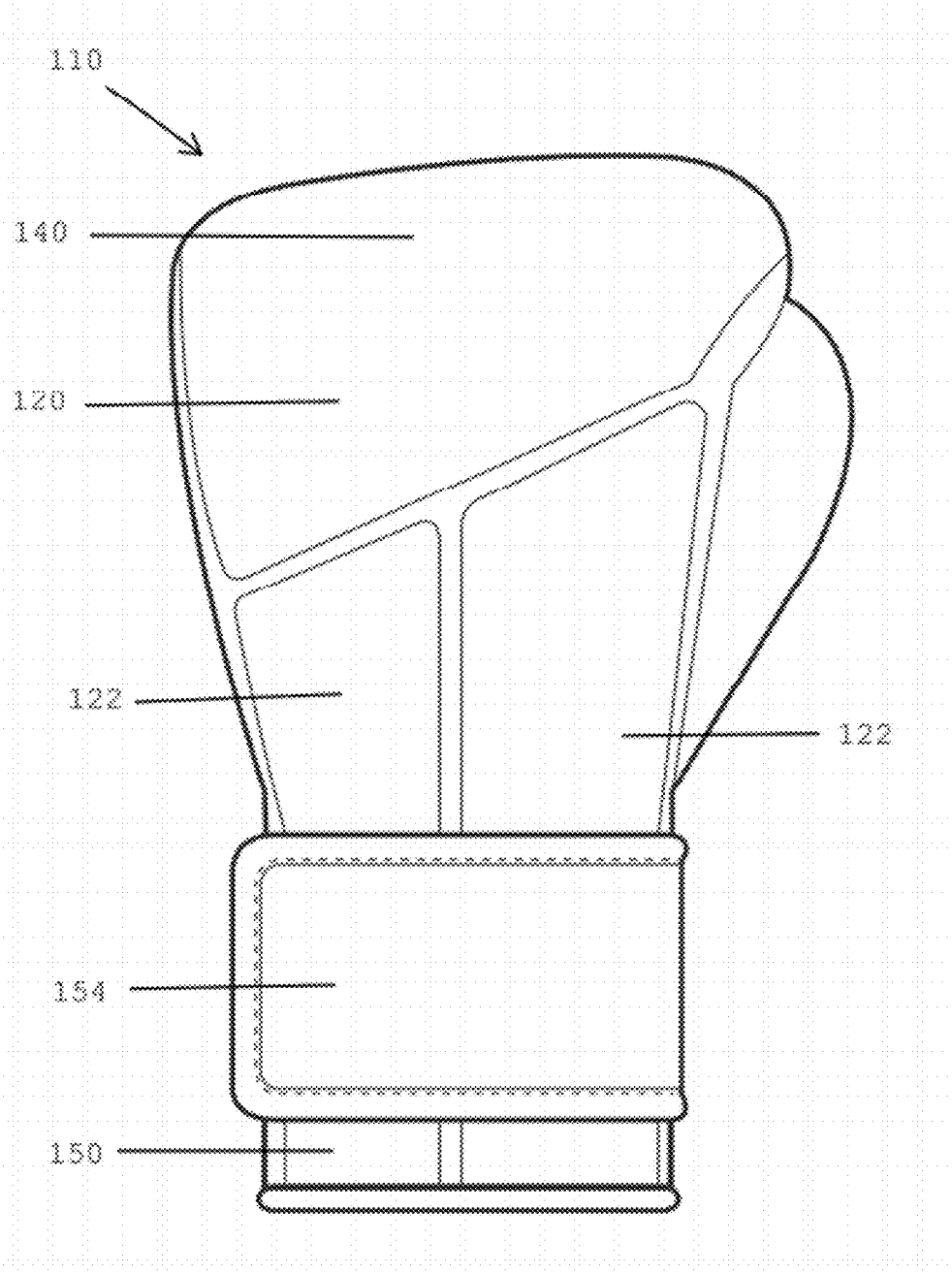
FIGS. 9 and 10 are dorsal and palm views of another alternative embodiment of the glove in FIG. 1B featuring a lace and strap-based gap closure system and using multiple support elements for the splint portion.
Figure 10:
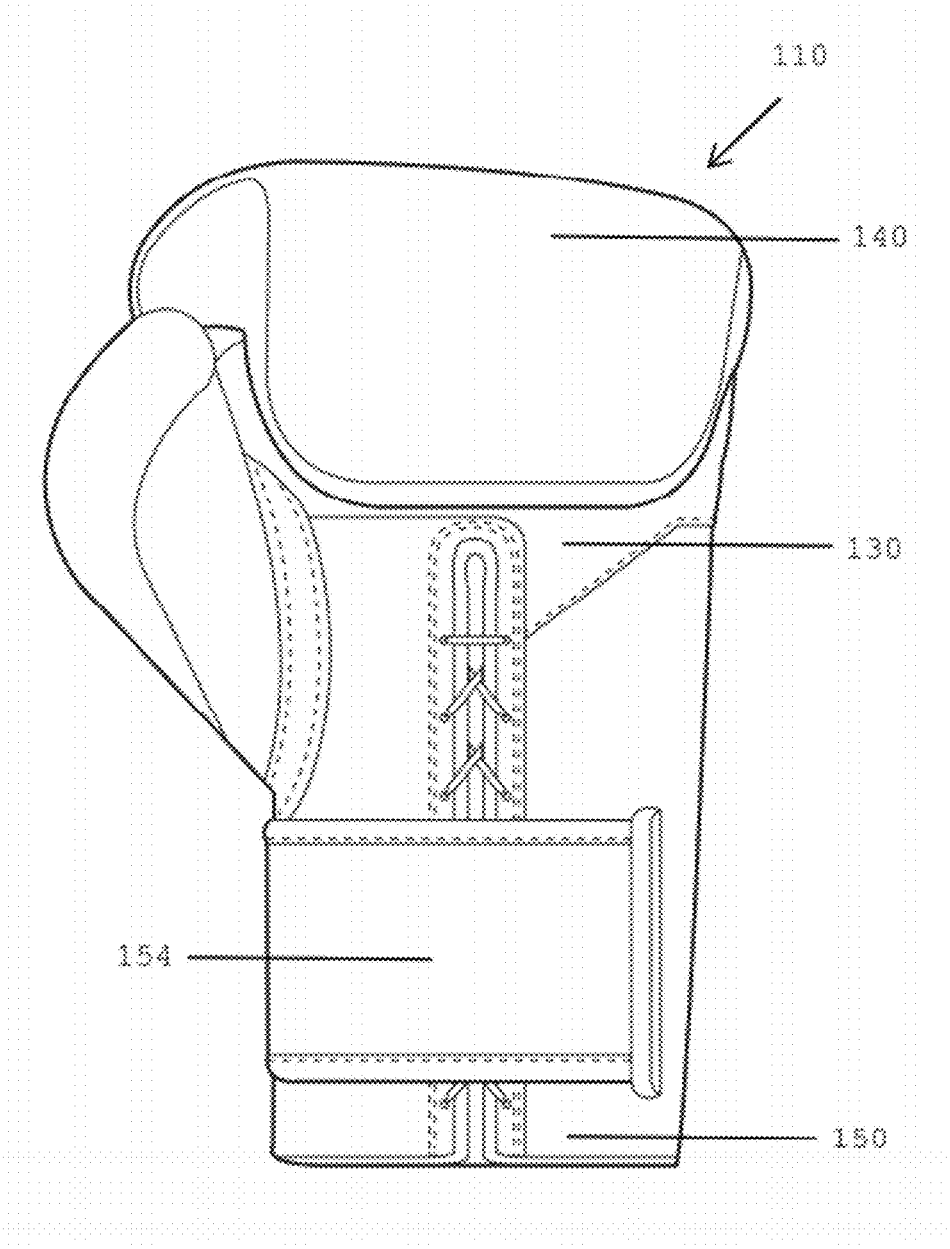

Referring to FIGS. 9 and 10, yet another alternative embodiment of the present invention is illustrated. In this alternative embodiment, the gap closure system used is a combination of a strap and a lace and eyes subsystem as shown in FIGS. 8 and 9. In FIGS. 9 and 10, the glove 110 has a single primary strap system. FIG. 9 shows a glove 110 having a dorsal portion 120, a finger portion 140, a wrist portion 150, a primary support strap 154, and a splint portion 122 having two splint support elements. A finger portion 140 is comprised of two separate compartments: one for receiving the thumb and one for receiving the second, third, fourth, and fifth fingers. The primary support strap 154 is shown in a fastened position across the dorsal side of wrist portion 150. FIG. 10 shows the volar portion 130 of glove 110 with a gap closure system which uses lace and eyes, similar to that illustrated in FIG. 8, along with a single primary strap 154. The primary support strap 154 is shown in a fastened position across the volar portion 130 of wrist portion 150 and extending around wrist portion 150 to the dorsal portion 120 (not shown in this view). The strap 154 partially wraps around the wrist portion 150 and is secured to the dorsal side of the wrist portion 150.

Figure 11:
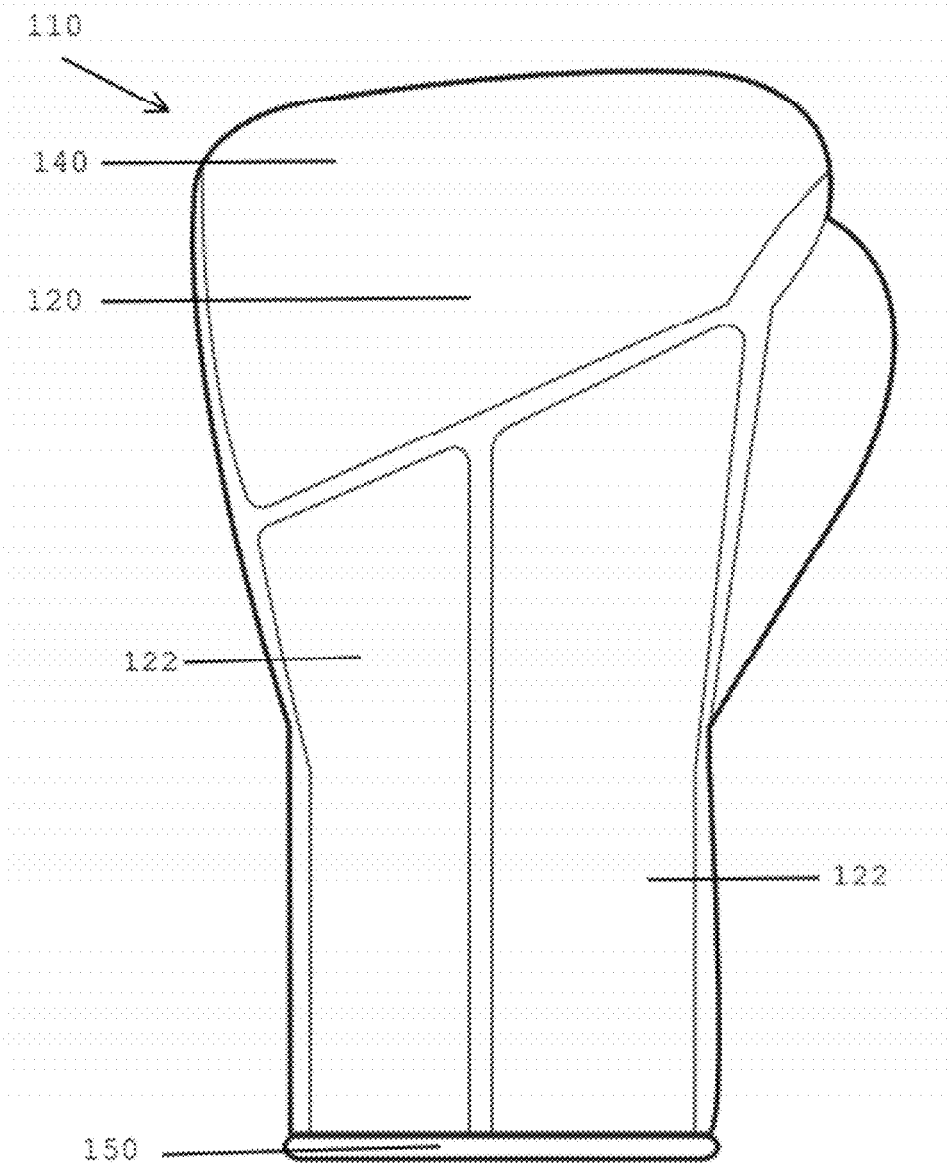
FIGS. 11 and 12 are dorsal and palm views of another alternative embodiment of the glove in FIG. 1B featuring a reel-base gap closure system and using multiple support elements for the splint portion.
Figure 12:
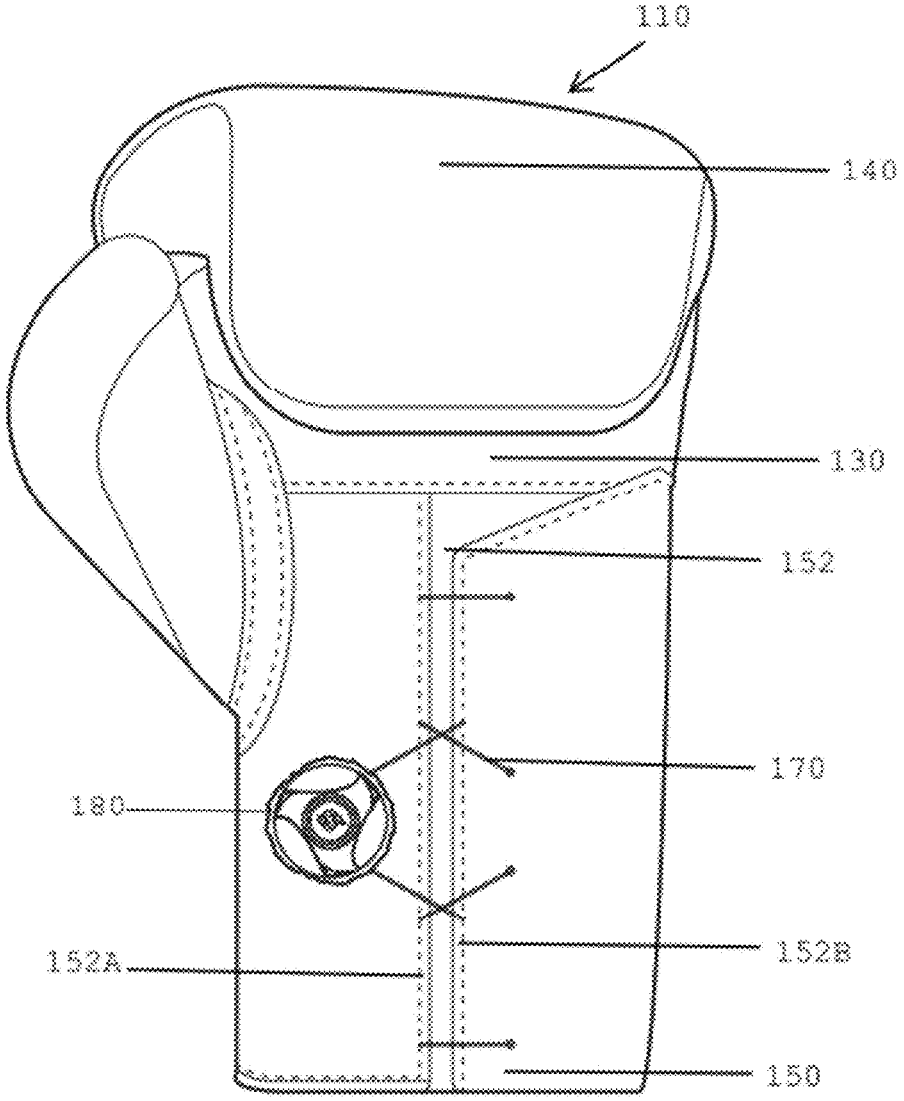

Referring to FIGS. 11 and 12, illustrated is an embodiment of the invention which uses another gap closure system. In this embodiment, the gap closure system uses one or more laces which are threaded across the gap and through multiple eyes on the glove. Tightening the laces involves rotating a ratcheted wheel or reel that winds the laces around a spindle. FIG. 11 is a dorsal view of glove 110 corresponding to FIG. 7. FIG. 12 shows glove 110 having a volar portion 130, a finger portion 140, a wrist portion 150, a lace 170, and the gap closure system using a reel or wheel, rotation of which tightens the wrist portion 150 to the wrist. Similar to some of the previous embodiments, finger portion 140 is comprised of two separate compartments: one for receiving the thumb and one for receiving the second, third, fourth, and fifth fingers. FIG. 12 shows glove 110 in a palm side view, illustrating the wrist portion 150 being formed with a gap 152. The wrist portion 150 has a thumb-side edge 152A and an opposing-side edge 152B. The gap 152 allows for the wrist portion 150 and volar portion 130 to open and accommodate the hand. For this embodiment, the gap closure system uses a reel or wheel 180. In one implementation, tightening the wrist portion 150 to the wrist is done by rotating the reel or wheel 180. Such a lace tightening system as that explained in U.S. Pat. No. 8,277,401 or similar such systems, such that those marketed under the trade name Boa® Closure System, may be used. In FIG. 12, lace 170 is attached across the gap 152 to the thumb-side edge 152A and the opposing-side edge 152B and to the reel 180. The reel-based system facilitates the closure of the gap 152 by pulling the lace 170 that is attached across the gap 152 to form a tight fit of the wrist portion 150 to the wrist.

Figure 13:
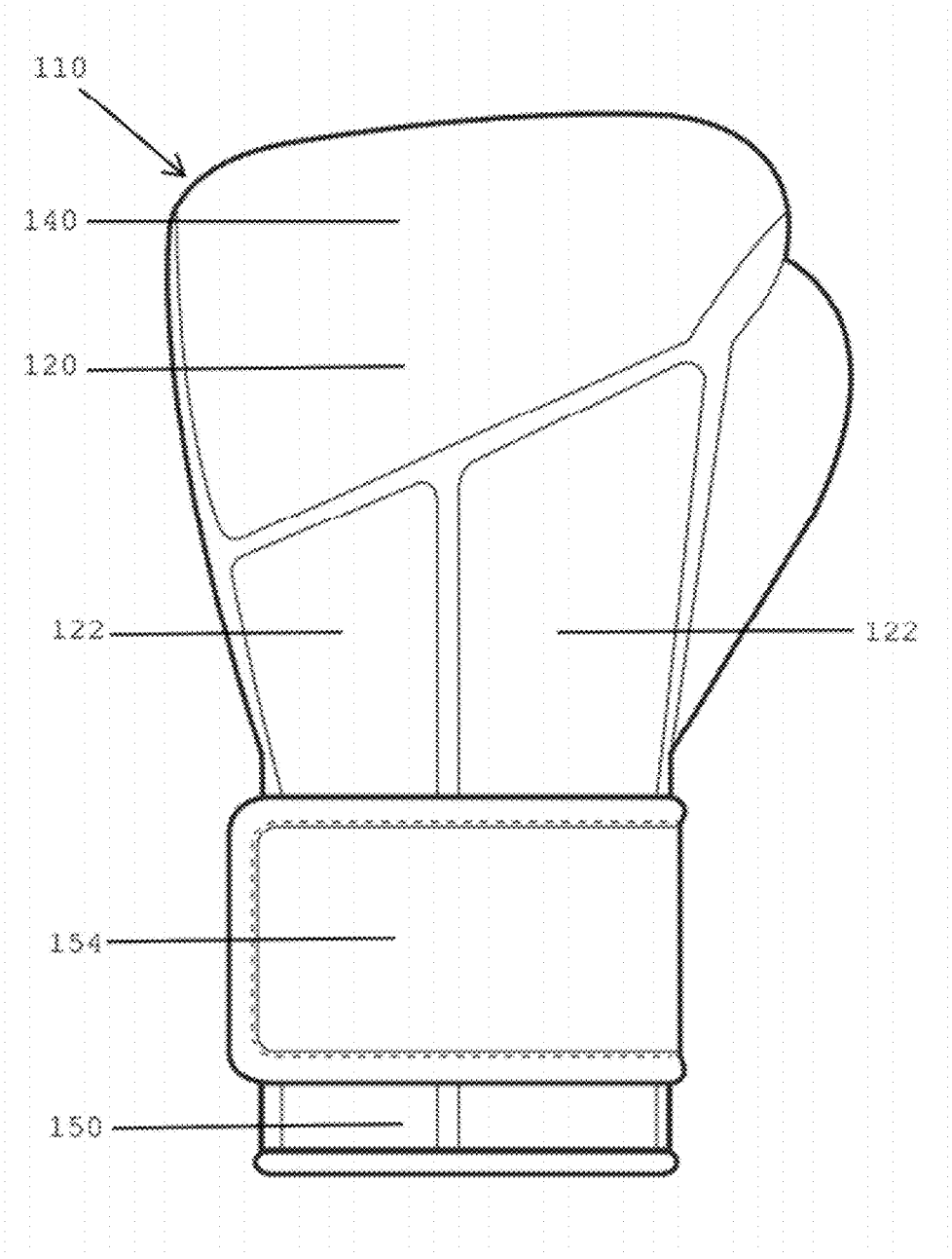
FIGS. 13 and 14 are dorsal and palm views of another alternative embodiment of the glove in FIG. 1B featuring a single strap-based gap closure system and using multiple support elements for the splint portion.
Figure 14:
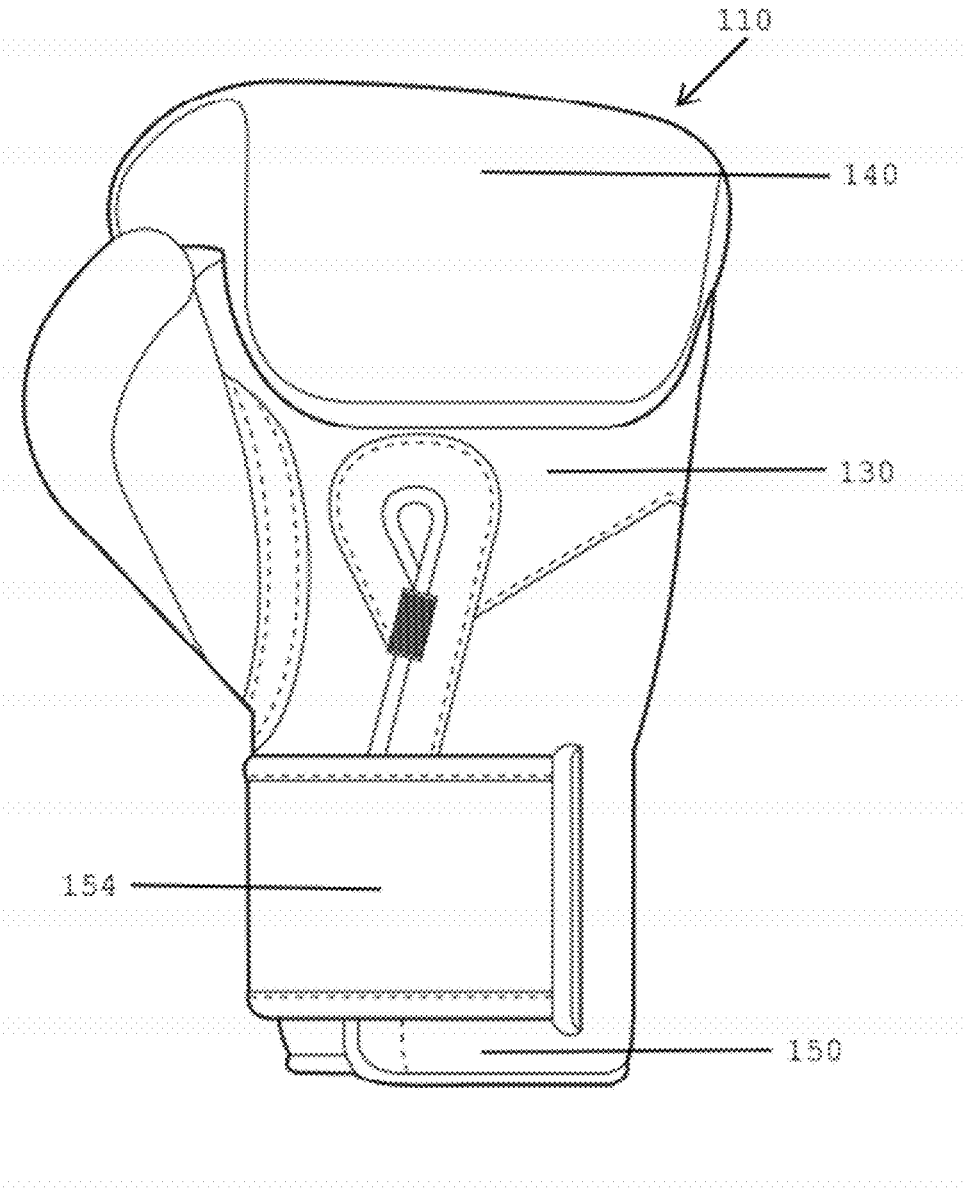

Referring to FIGS. 13 and 14, illustrated is another embodiment of the invention. In this embodiment, the gap closure system is a single strap which wraps around the wrist and is secured to the dorsal side of the wrist portion. In one implementation, the single strap is secured using hooks and loops such as that marketed under the trade name Velcro®. FIGS. 13 and 14 show a glove 110 using a single strap system. These illustrations correspond to FIGS. 9 and 10, respectively and, for ease of reference, like parts are identified by the same reference numerals.

Figure 15:
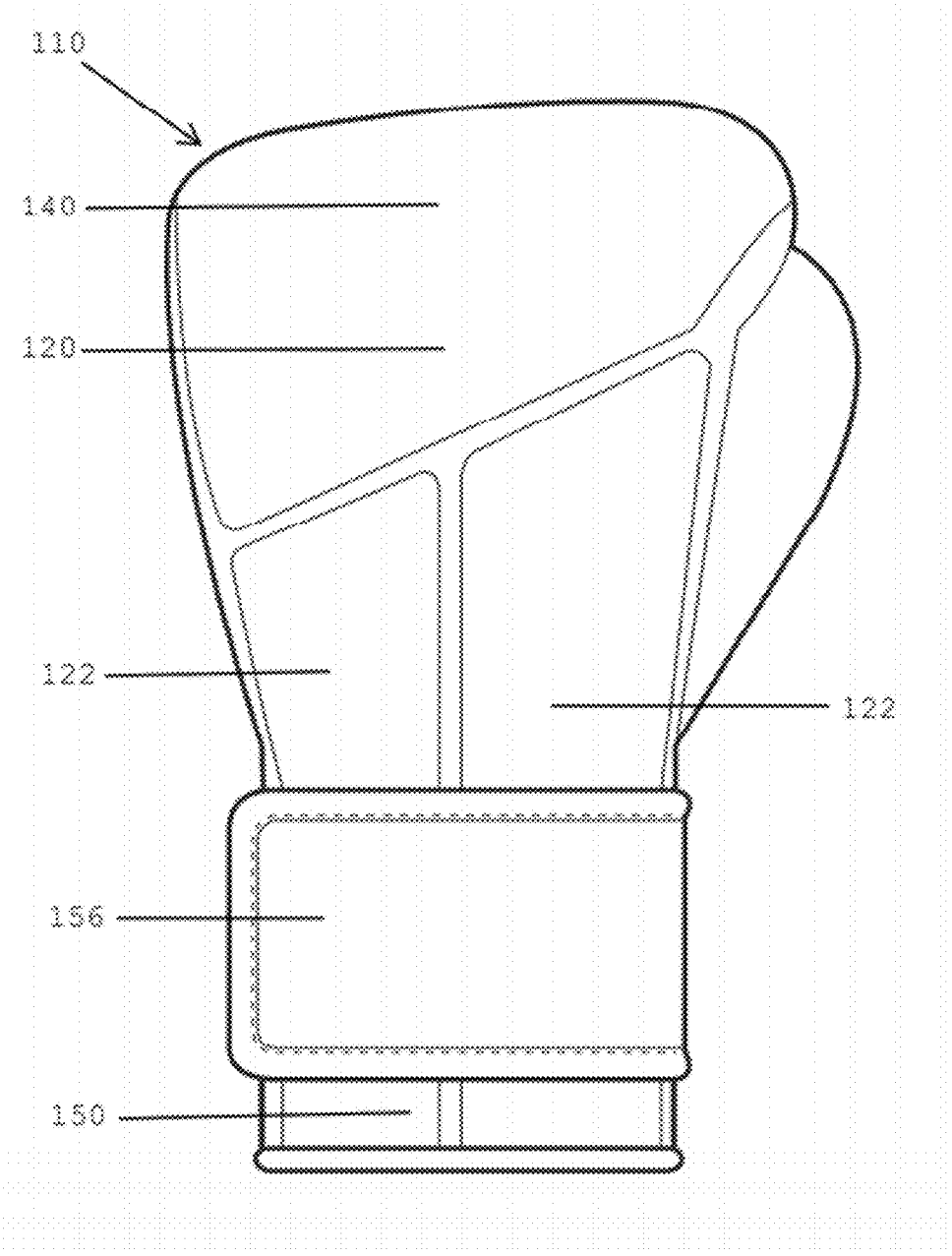
FIGS. 15 and 16 are dorsal and palm views of another alternative embodiment of the glove in FIG. 1B featuring a dual strap-based gap closure system and using multiple support elements for the splint portion.
Figure 16:
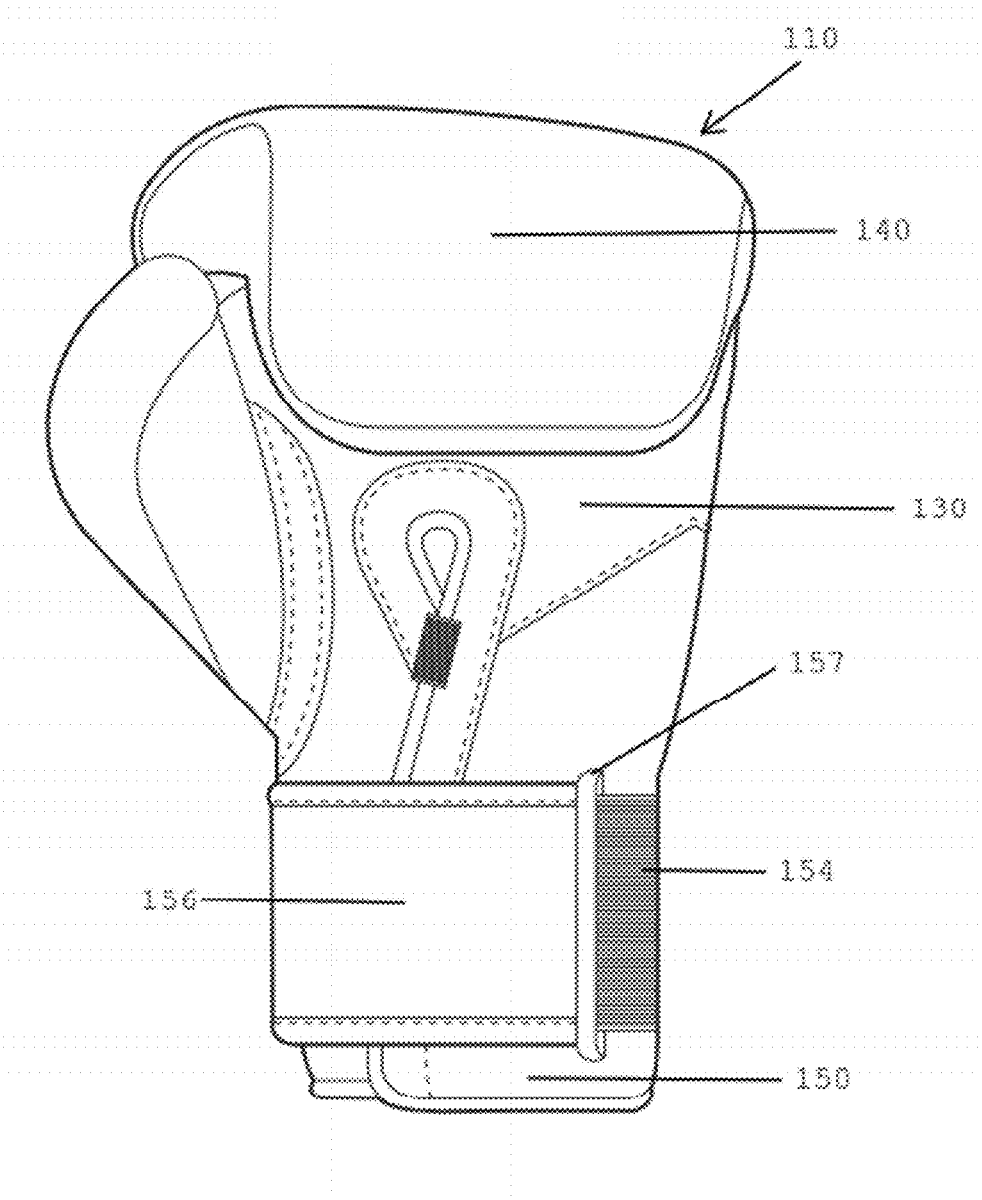

Referring to FIGS. 15 and 16, illustrated is an embodiment of the invention using a multiple support elements for the splint portion and dual straps and a slot for the gap closure system. The multiple support elements for splint portion 122 can be seen in FIG. 15 while the slot 157 and the primary support strap 154 and the secondary support strap 156 can be seen in FIG. 16. The dual straps and the slot are similar to those described and illustrated in FIGS. 1B-4B.

Figure 17:
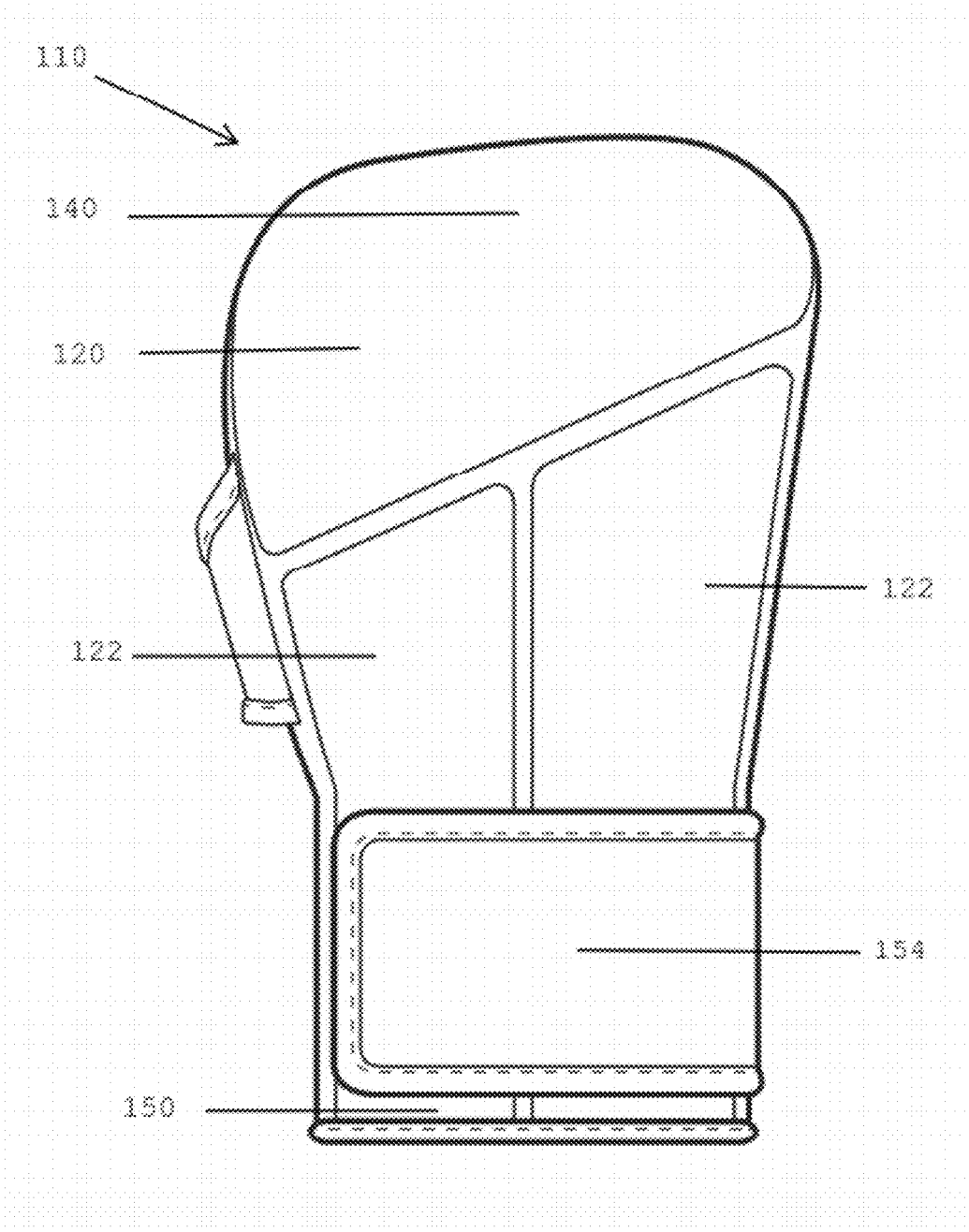
FIGS. 17 and 18 are dorsal and palm views of an alternative embodiment of the glove in FIG. 1A featuring a single strap-based gap closure system and using multiple support elements for the splint portion.
Figure 18:
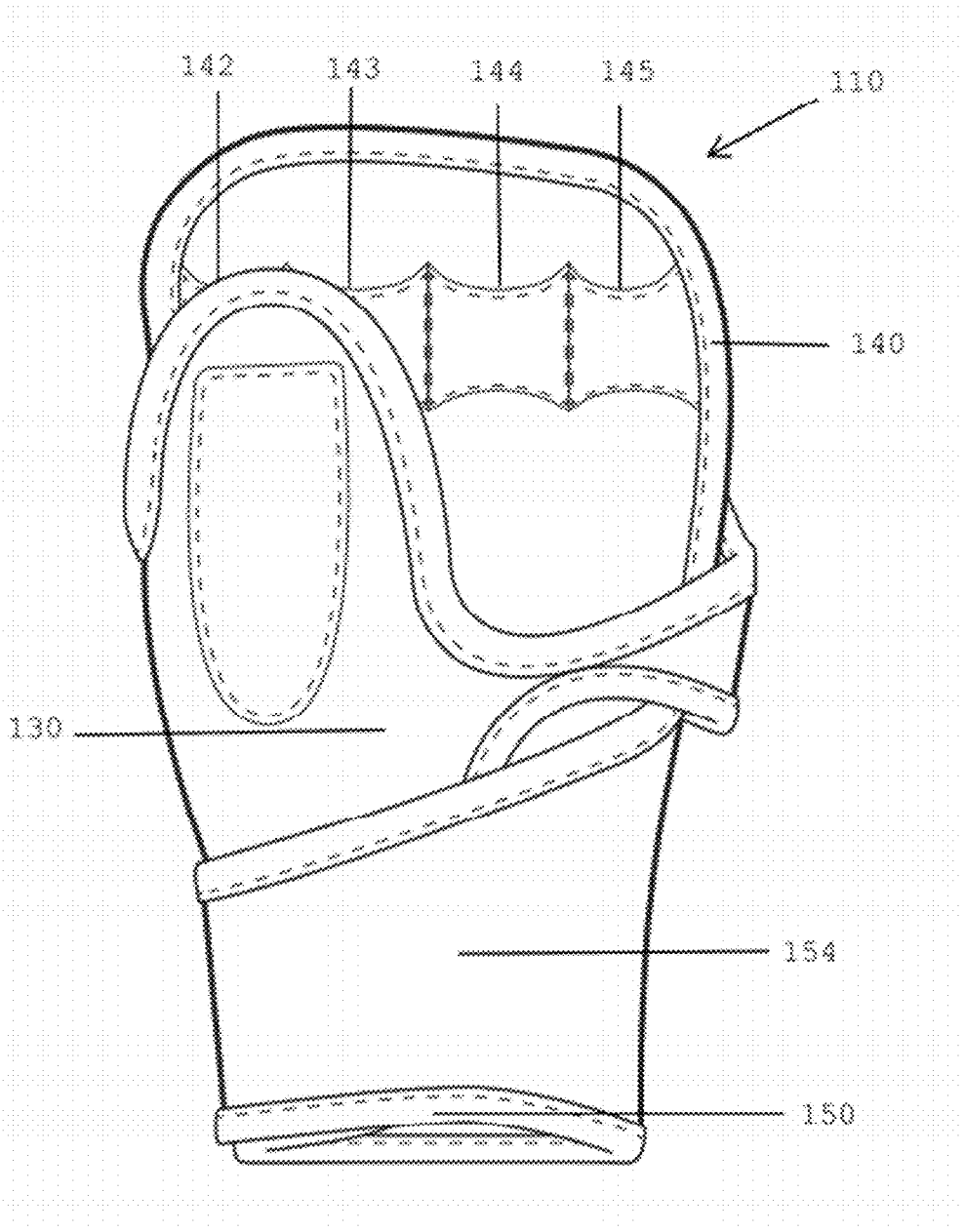

Referring to FIGS. 17 and 18, illustrated is an alternative embodiment of the glove described and illustrated in FIG. 6C. In this alternative, the glove has multiple support elements in the splint portion 122 and uses a single strap for the gap closure system.

Figure 19:
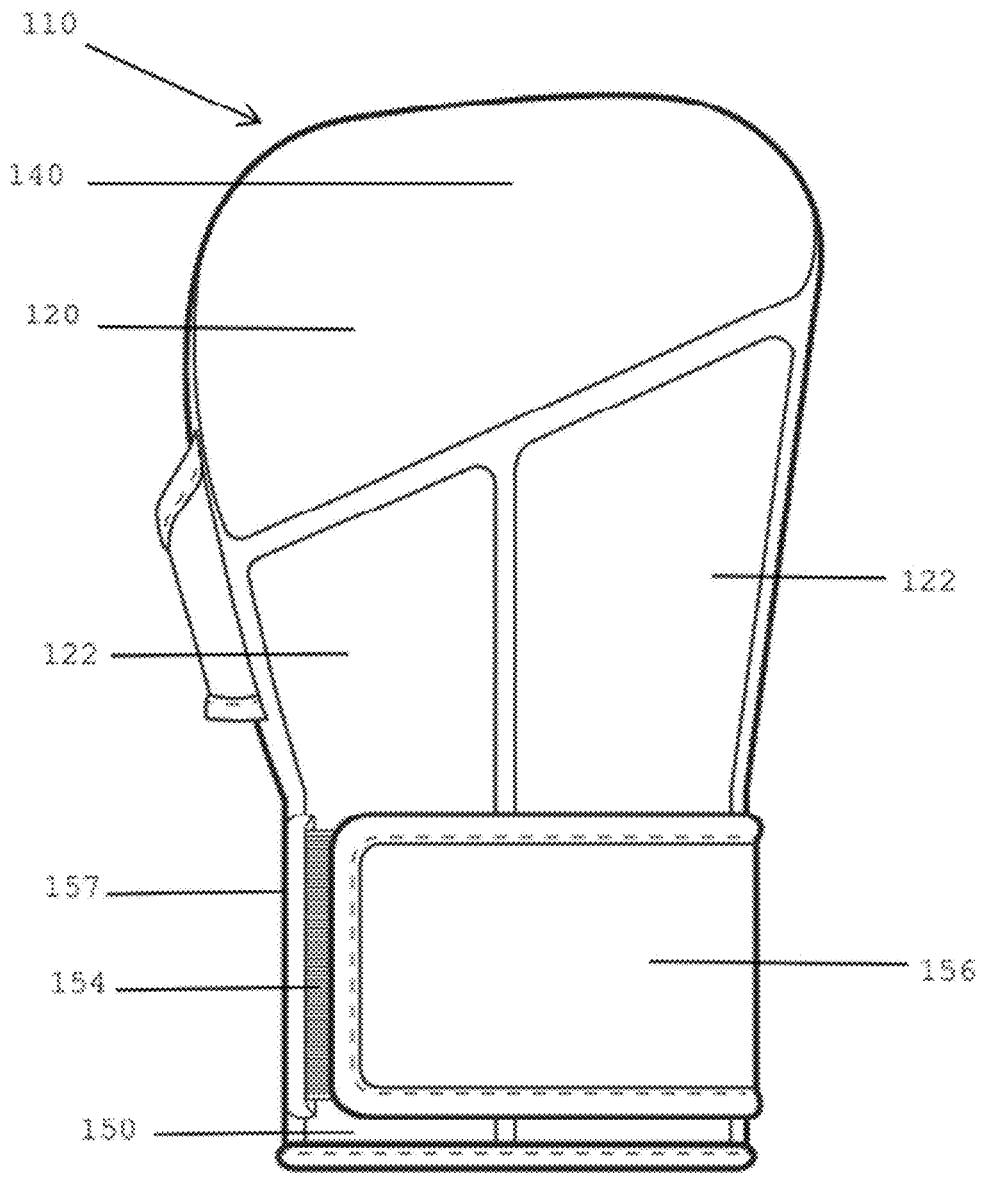
FIGS. 19 and 20 are dorsal and palm views of another alternative embodiment of the glove in FIG. 1A featuring a dual strap-based gap closure system and using multiple support elements for the splint portion.
Figure 20:
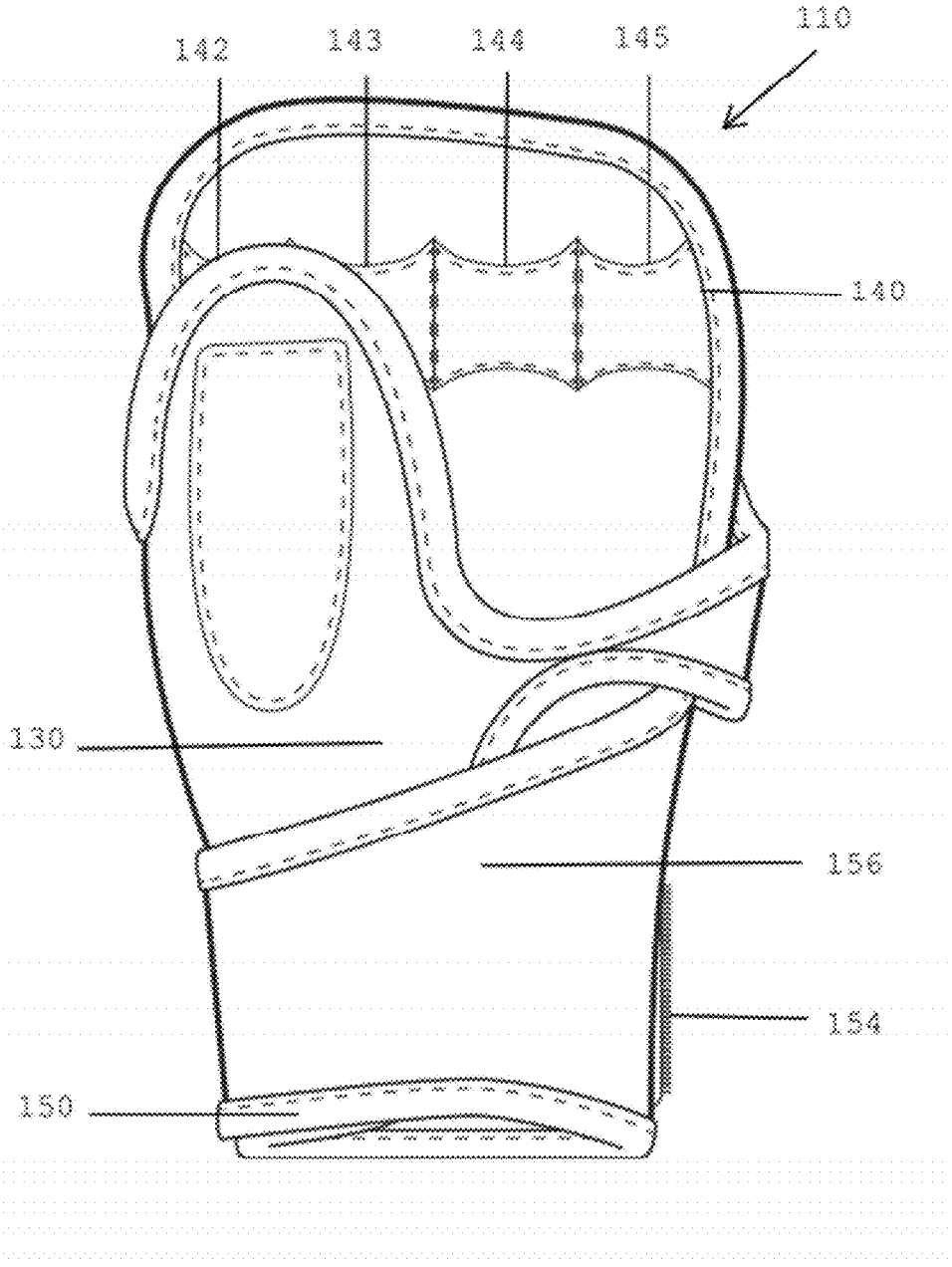

Referring to FIGS. 19 and 20, an alternative embodiment of the glove illustrated and described for FIGS. 17 and 18 is illustrated. In the embodiment in FIGS. 19 and 20, the gap closure system uses dual support straps and a slot such as those explained with reference to FIGS. 1A-4A and FIGS. 15 and 16.

Figure 21:
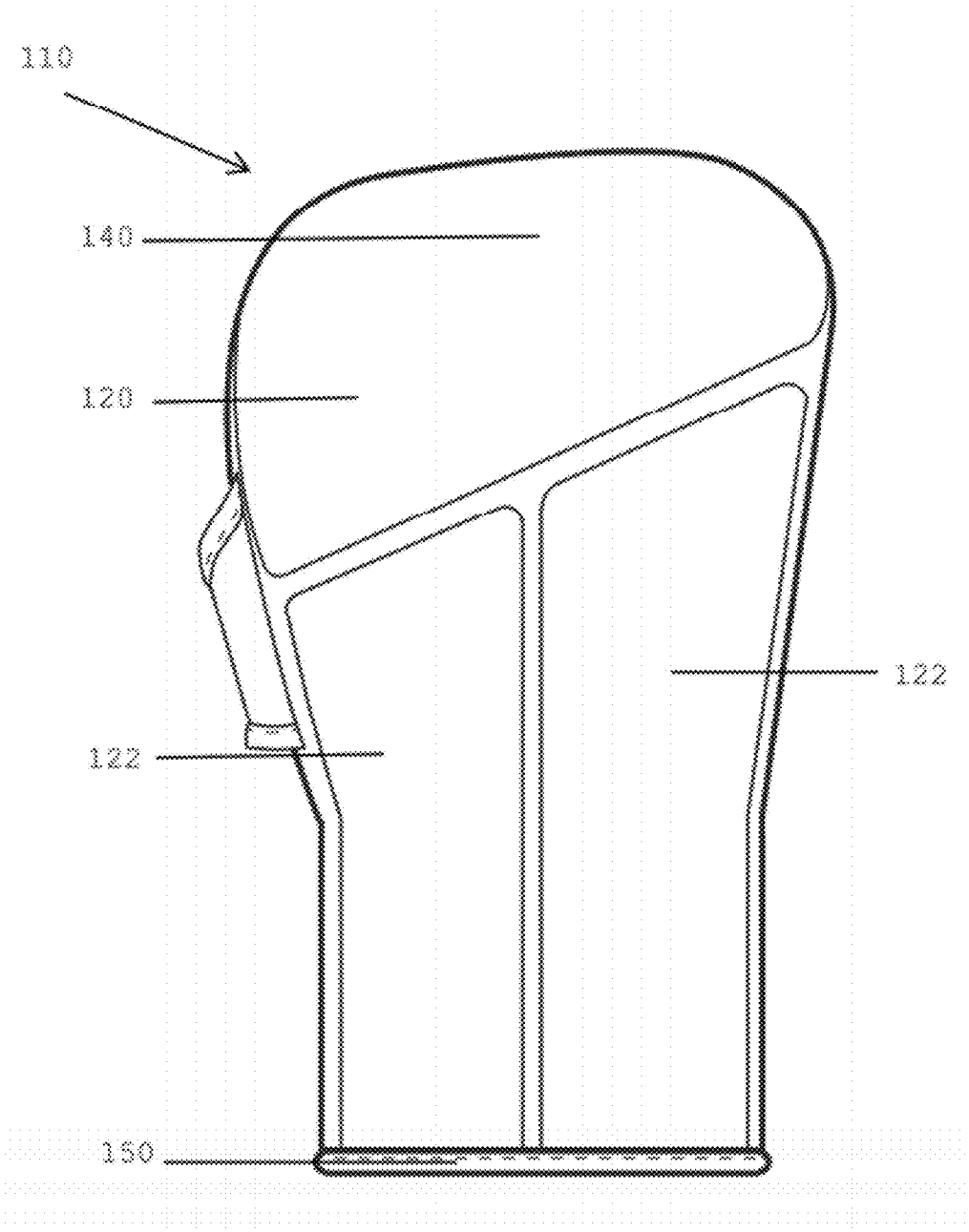
FIGS. 21 and 22 are dorsal and palm views of another alternative embodiment of the glove in FIG. 1A featuring a reel-based gap closure system and using multiple support elements for the splint portion.
Figure 22:
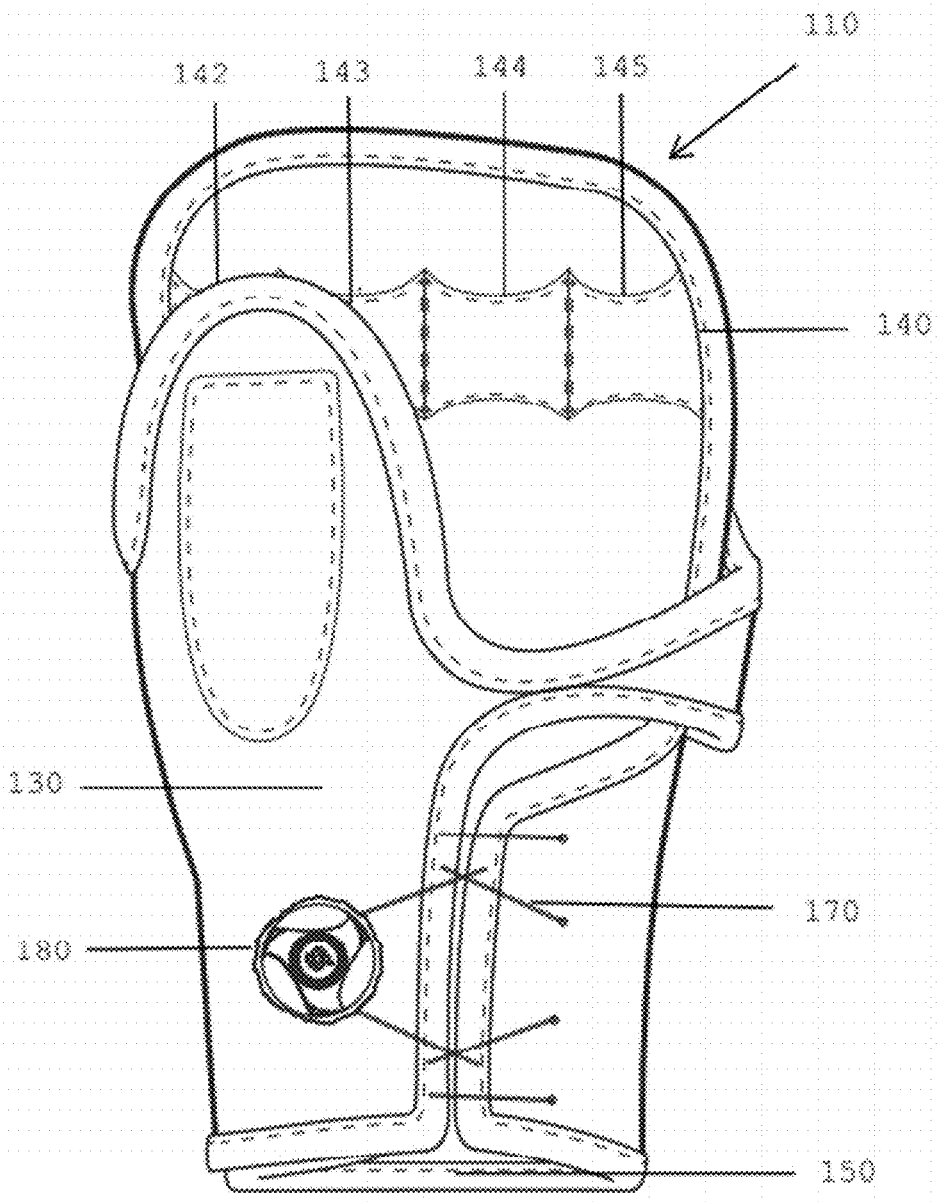

Referring to FIGS. 21 and 22, pictured is yet another alternative embodiment of the glove illustrated in FIGS. 17 and 18. In this alternative embodiment, two support elements are used for the splint portion and the gap closure system uses the reel and lace based system illustrated and explained with reference to FIGS. 11 and 12. For ease of reference, similar features on the different embodiments are indicated by similar reference numerals.

Figure 23:
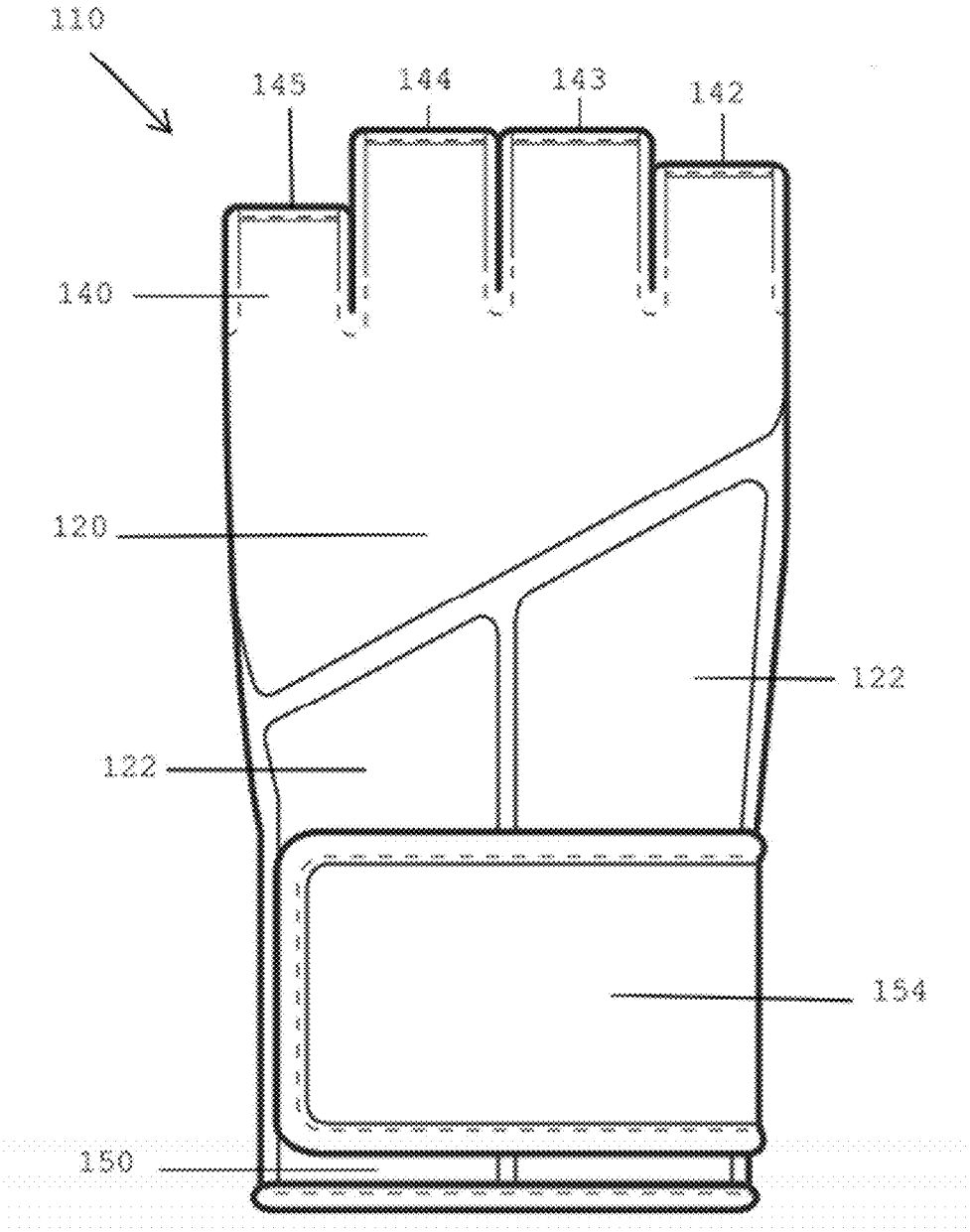
FIG. 23 illustrates a dorsal view of another alternative embodiment of the glove in FIG. 1A featuring a single strap gap closure system and multiple support elements for the splint portion.
Figure 24:
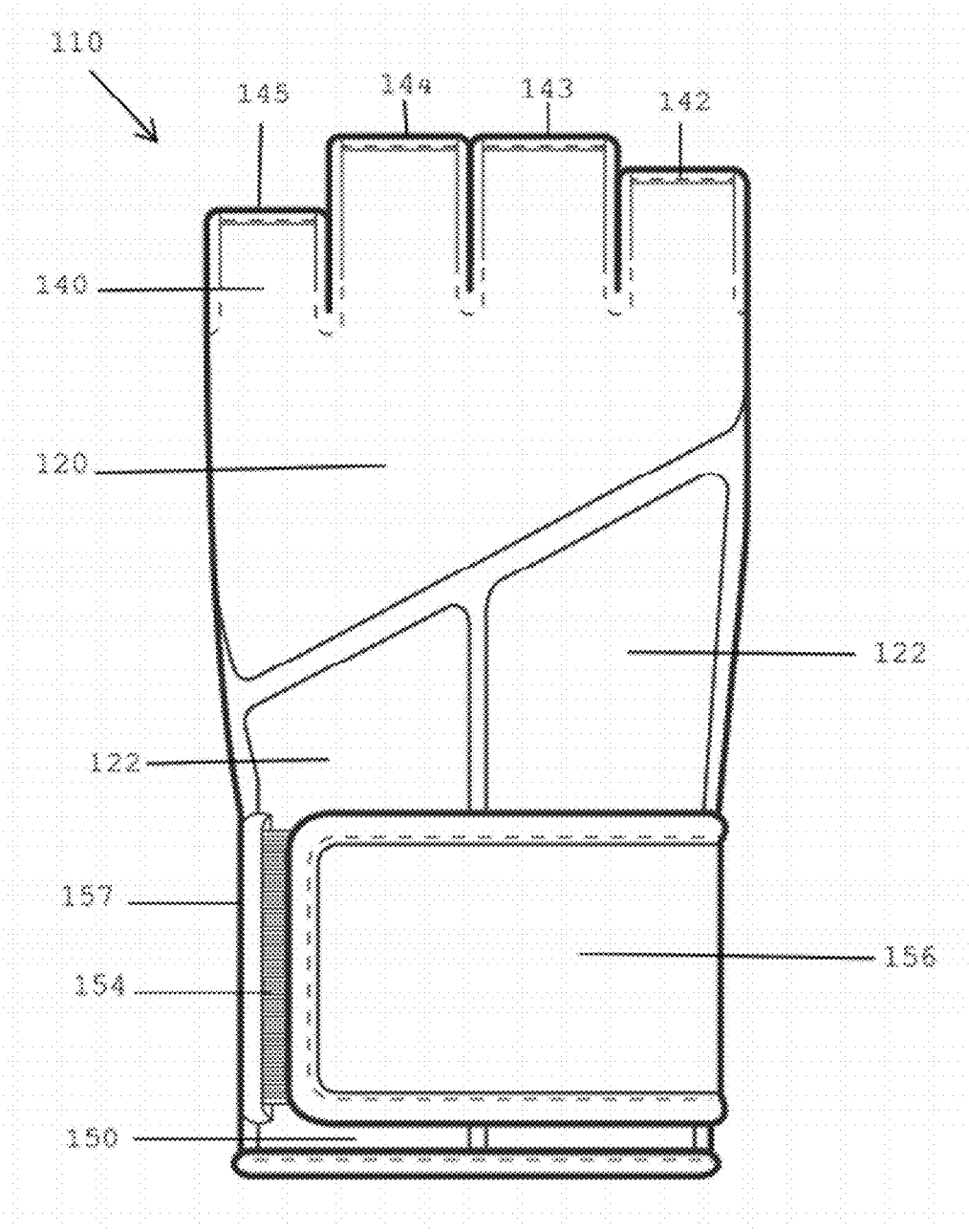
FIG. 24 illustrates a dorsal view of another alternative embodiment of the glove in FIG. 1A featuring a dual strap gap closure system and multiple support elements for the splint portion.
Figure 25:
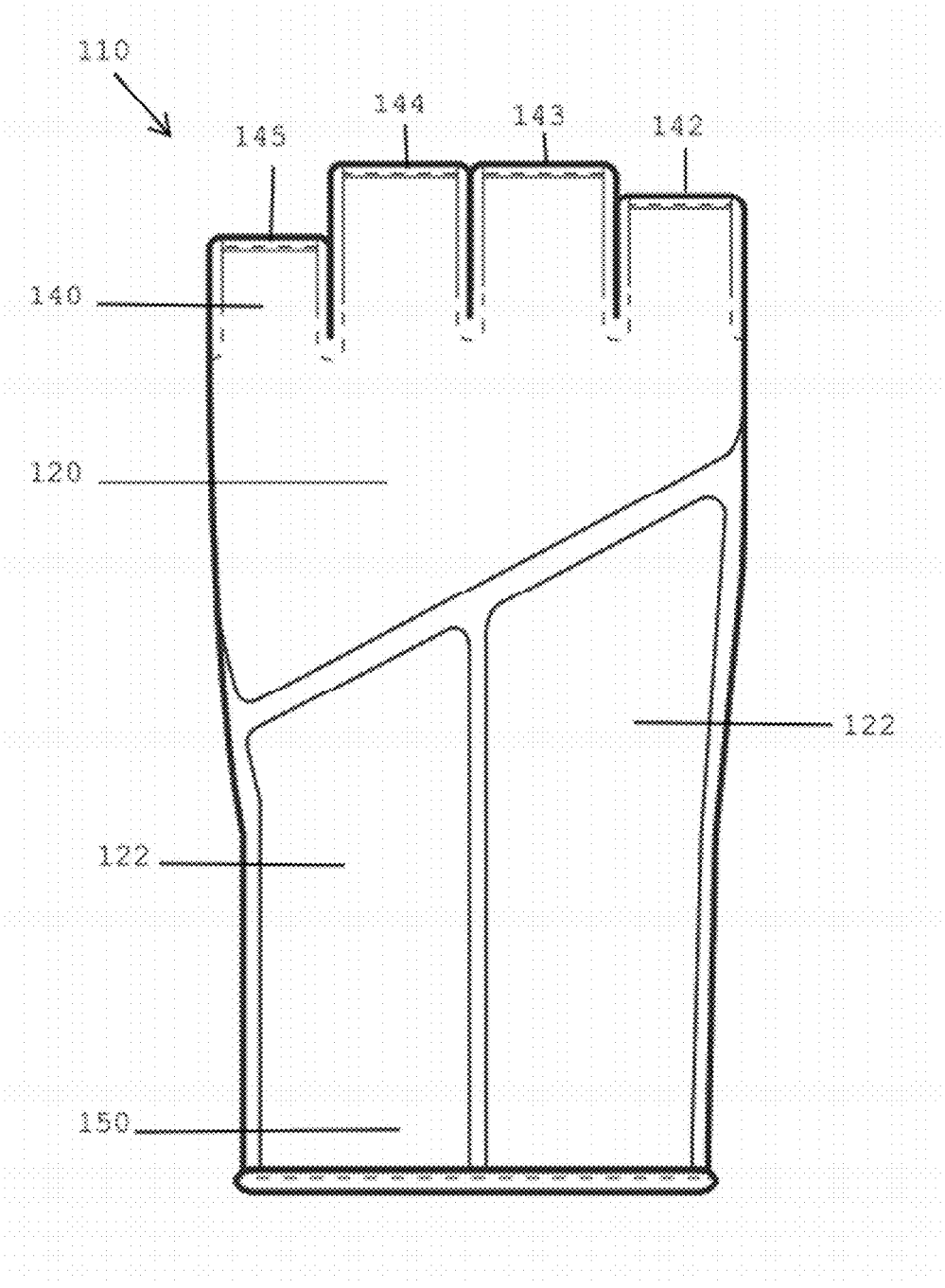
FIG. 25 illustrates a dorsal view of another alternative embodiment of the glove in FIG. 1A featuring multiple support elements for the splint portion.

Referring to FIGS. 23, 24, and 25, illustrated are alternative embodiments of the glove illustrated in FIGS. 1A-4A. Only the dorsal views of these alternatives are illustrated. In FIG. 23, the glove 110 has two support elements for the splint portion 122 and, for the gap closure system, a single support strap 154 is used. For the alternative in FIG. 24, again two support elements are used for the splint portion 122 and two support straps 154, 156 are used for the gap closure system. For the alternative in FIG. 25, the reel and lace based gap closure system is used along with two support elements for the splint portion 122.

Figure 26:
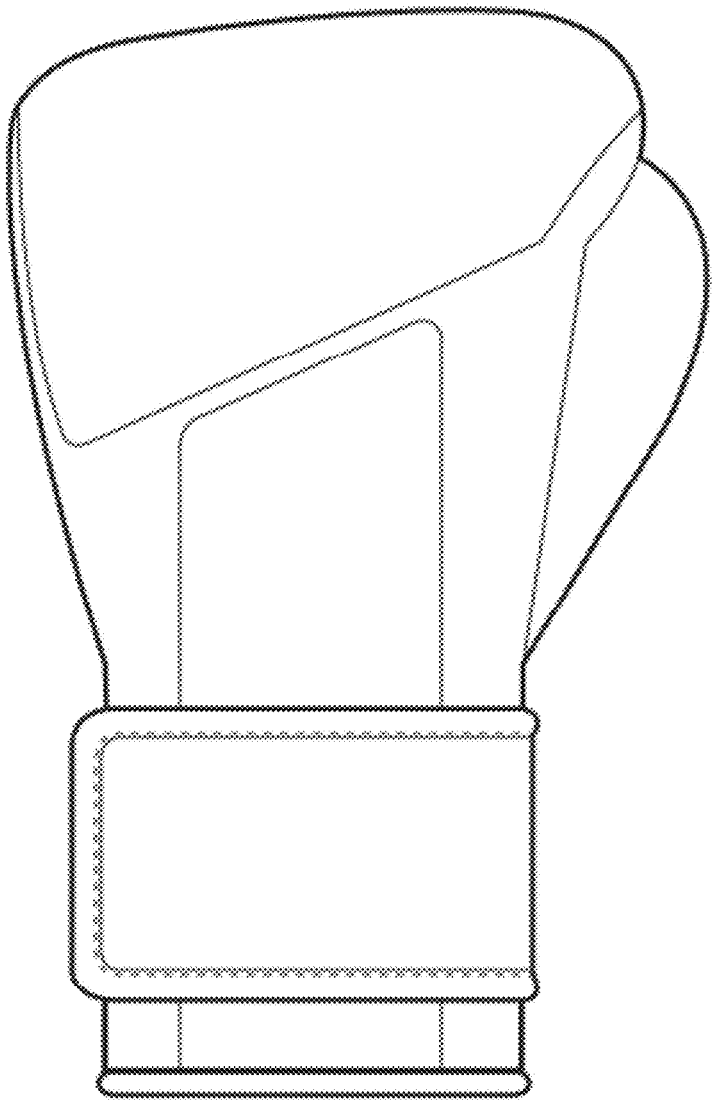
FIG. 26 illustrates a dorsal view of an alternative embodiment of the glove in FIG. 1B featuring a single strap-based gap closure system and a single support element for the splint portion.
Figure 27:
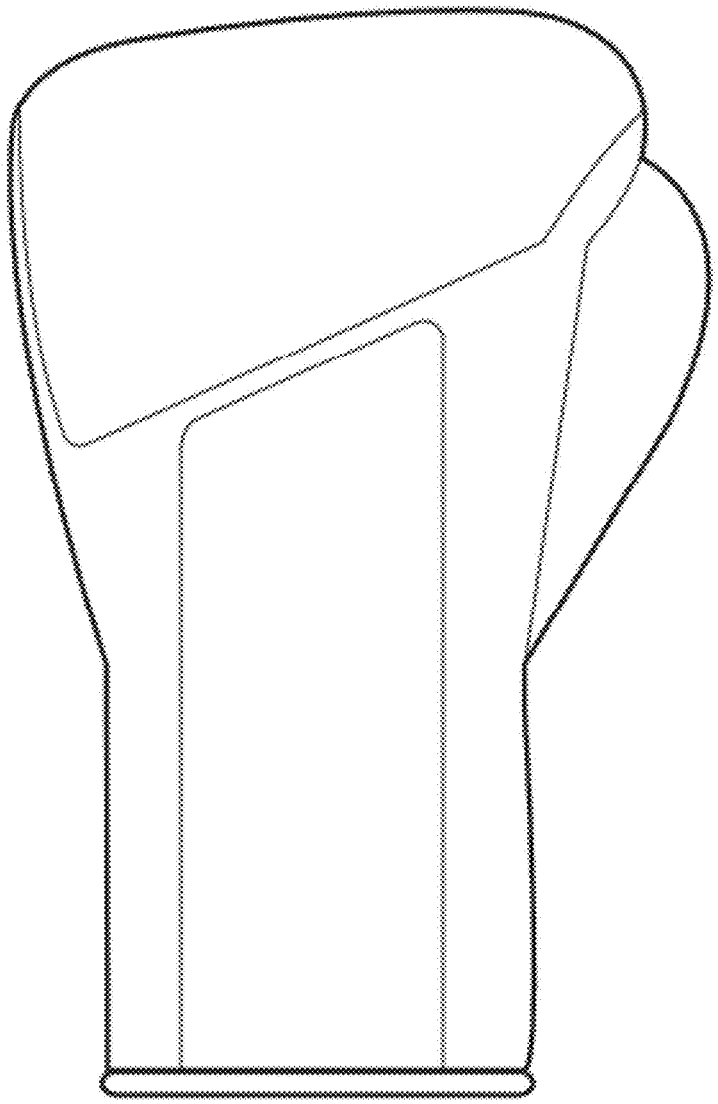
FIG. 27 illustrates a dorsal view of an alternative embodiment of the glove in FIG. 1B featuring a single support element for the splint portion and a gap closure system which does not use a strap.

It should be clear that while the embodiments of the invention illustrated so far use two or three support elements in the splint portion of the glove, a single support element may also be used. Referring to FIGS. 26 and 27, dorsal views of an alternative glove using a single support element for the splint portion are illustrated. While the gloves in FIGS. 26 and 27 are boxing gloves, alternative mixed martial arts gloves would have a similar configuration for the splint portion.

In one embodiment, the present invention provides gloves with improved wrist closure and wrist support for improved fit and function by providing a dual cross directional strap system with the combination of a primary support strap having an elastic, stretchable portion and a non-stretchable secondary support strap and a splint portion which uses one or more splint support elements. Advantageously, gloves in accordance with the various embodiments of the present invention prevent rapid loosening and maintain proper fit and function for longer periods of time than those of the prior art.

Further improvements in fit and function are provided, in certain embodiments of the invention, by inclusion of a volar Y-shaped structure. Here, the glove includes a contouring hand/fist Y-shaped structure to generate a bare-knuckle like contour glove to support maximal force production during striking, while providing a proper fit during open-hand grabbing and repeated transitions between opened and closed hand. This Y-shaped structure is particularly well-suited to mixed martial arts gloves.

The gloves according to various embodiments may be constructed of material commonly used to manufacture combat sport gloves. Such materials include leather, cotton, vinyl, polyester, and combinations of different materials. Synthetic leather such as poly urethane may be used. Materials such as, acrylic and poly vinyl chloride, and microfiber, cellulose, including rayon, modal, lyocell, polyamide nylon, petroleum (PET) or polybutylene Terephthalate (PBT) polyester, phenol-formaldehyde (PF), polyvinyl alcohol fiber (PVOH), polyvinyl chloride fiber (PVC), polyolefins (PP and PE), or acrylic polymers, acrylic fiber, carbon fibers and PF fibers, aromatic nylons, such as Kevlar™ and Nomex™. Fibers that have strong bonding between polymer chains (e.g., aramids), or extremely long chains (e.g., Dyneema™ or Spectra™). Elastomers may also be used, e.g., spandex. The padding, including the pads of the splint portion may be constructed of commonly known material such as nylon, cotton, foam, rubber, plastic, silicone, polyurethane, polyethylene, polyborosiloxine, ethylvinylacetate and polyvinylchloride. The padding may also be constructed as composites or layers of different materials. The specific material and thickness will depend on the amount of impact protection and the desired rigidity to resist unwanted bending of the wrist. Semi-rigid materials may be used as backing for the splint portion support elements to provide resistance to wrist bending.

The specific features herein described may be used in a variety of specific glove types. For example the features may be incorporated into gloves commonly worn in specific combat sports such as boxing, kick-boxing, and mixed martial arts. Such gloves may be of different weights including, but not limited to, 4 oz, 6 oz, 8 oz, 10 oz, 12 oz, 14 oz, 16 oz, 18 oz, and 20 oz. However, it has been found that these features are best-suited to 10 oz, 12 oz, 14 oz, 16 oz, and 18 oz gloves.

A person understanding this invention may now conceive of alternative structures and embodiments or variations of the above all of which are intended to fall within the scope of the invention as defined in the claims that follow.

We claim:

1. A protective sports glove comprising:

a body having:

a finger portion for fingers;

a wrist portion for a wrist having a dorsal side and a volar side; wherein the finger portion has a first section for covering second, third, fourth and fifth fingers together; and a splint portion for supporting said wrist, said splint portion being adjacent to said wrist portion;

wherein the volar side of the wrist portion has a gap for adjustably securing the glove to accommodate the wrist, and wherein the gap has a thumb-side edge and an opposing-side edge, wherein the gap terminates in a vertical direction prior to the finger portion;

wherein the wrist portion comprises a primary support strap, and a primary support slot;

wherein the primary support strap is attached to the volar side of the wrist portion on a first side of the gap, wherein the primary support strap slot is located on an opposite side of the gap relative to the primary support strap, and wherein the primary support strap is adapted for fastening to the dorsal side of the wrist portion and the primary support strap is constructed and arranged to pass across the gap and through the primary support slot to the dorsal side of the wrist portion for fastening the primary support strap to a complementary fastening on the dorsal side of the wrist portion;

wherein the primary support strap is constructed and arranged to be pulled through the primary support slot to narrow the gap and to tightly conform the wrist portion to the wrist.

2. The protective sports glove according to claim 1, wherein the primary support strap is at least partially encircling the wrist portion.

3. The protective sports glove according to claim 1, wherein the splint portion comprises at least one non-rigid splint support element which extends from the finger portion to the wrist portion.

4. The protective sports glove according to claim 3, wherein the primary support strap is at least partially encircling the wrist portion.

5. The protective sports glove according to claim 2, wherein the wrist portion further comprises a secondary strap, wherein the primary support strap being for wrapping around the wrist portion in a first direction, the secondary strap being for wrapping around the wrist portion in a second direction, the second direction being opposite to the first direction, wherein at least one of: the primary support strap and the secondary strap at least partially encircles the wrist portion.

6. The protective sports glove according to claim 5, wherein the splint portion comprises at least one non-rigid splint support element which extends from the finger portion to the wrist portion.

7. The protective sports glove according to claim 1, wherein the splint portion comprises at least one non-rigid splint support element located at the volar side.

8. The protective sports glove according to claim 1, wherein the wrist portion further comprises at least one lace threaded across a network of corresponding holes in the thumb-side edge and the opposing-side edge of the gap.

9. The protective sports glove according to claim 8, wherein the splint portion comprises at least one non-rigid splint support element which extends from the finger portion to the wrist portion.

10. The protective sports glove according to claim 8, wherein the splint portion comprises at least one non-rigid splint support element which extends from the finger portion to the wrist portion, the at least one non-rigid splint support element being located at the volar side.

11. The protective sports glove according to claim 5, wherein when the primary support strap and the secondary strap wrap around the wrist portion, there is an overlap between the primary support strap and the secondary strap.

12. The protective sports glove according to claim 1, wherein the wrist portion further comprises at least one of: the thumb-side edge and the opposing-side edge of the gap having hook and loop fasteners for closing the gap.

13. The protective sports glove according to claim 1, wherein the protective sports glove is for use in at least one of:

boxing;

mixed martial arts;

an activity involving a user of the protective sports glove striking an opponent; and an activity involving a user of the protective sports glove striking an object.

14. The protective sports glove according to claim 3, wherein the splint portion comprises an array of longitudinally parallel splint support elements extending from the finger portion to the wrist portion.

15. A protective glove according to claim 1, the splint portion comprises at least one non-rigid splint support element longitudinally perpendicular to an axis of bending of the wrist.

16. The protective sports glove according to claim 1, wherein the splint portion comprises an array of longitudinally parallel splint support elements extending from the finger portion to the wrist portion.

17. The protective sports glove according to claim 1, wherein the splint portion is resistant to a bending of the wrist.

18. The protective sports glove according to claim 1, wherein the finger portion has a second section for encircling a thumb.

* * * * *